US012485317B2

(12) United States Patent
Currier et al.

(10) Patent No.: US 12,485,317 B2
(45) Date of Patent: Dec. 2, 2025

(54) EXERCISE SYSTEMS AND RELATED METHODS

(71) Applicant: OSTEOSTRONG FRANCHISING, INC., Houston, TX (US)

(72) Inventors: Matthew Currier, Cypress, TX (US); James Youngblood, Richmond, TX (US)

(73) Assignee: True Wellness, Inc., Houston, TX (US)

( * ) Notice: Subject to any disclaimer, the term of this patent is extended or adjusted under 35 U.S.C. 154(b) by 0 days.

(21) Appl. No.: 18/700,804

(22) PCT Filed: Oct. 13, 2022

(86) PCT No.: PCT/US2022/078062

§ 371 (c)(1),
(2) Date: Apr. 12, 2024

(87) PCT Pub. No.: WO2023/064869

PCT Pub. Date: Apr. 20, 2023

(65) Prior Publication Data

US 2024/0416183 A1 Dec. 19, 2024

Related U.S. Application Data

(60) Provisional application No. 63/270,344, filed on Oct. 21, 2021, provisional application No. 63/256,351, filed on Oct. 15, 2021.

(51) Int. Cl.
*A63B 24/00* (2006.01)
*A63B 21/002* (2006.01)

(52) U.S. Cl.
CPC ..... *A63B 24/0087* (2013.01); *A63B 21/0023* (2013.01); *A63B 24/0062* (2013.01); (Continued)

(58) Field of Classification Search
CPC ..... A63B 21/0023; A63B 21/0058; A63B 21/159; A63B 21/4035; A63B 21/4047; (Continued)

(56) References Cited

U.S. PATENT DOCUMENTS 11,752,059 B2 * 9/2023 Taivainen ..... A63B 23/1209 601/5
11,896,540 B2 * 2/2024 Mason ..... A63B 21/4029
(Continued)

OTHER PUBLICATIONS

International Search Report and Written Opinion for International Application No. PCT/US2022/078062, mailed Jan. 13, 2023, 7 pages.

*Primary Examiner* — Megan Anderson
(74) *Attorney, Agent, or Firm* — Haynes and Boone, LLP

(57) ABSTRACT

An exercise apparatus and related method according to which the exercise apparatus includes a loading interface, a user support, and a load-bearing mechanism operably coupled between the loading interface and the user support. A load-bearing mechanism adapted to be operably coupled between a loading interface and a user support of an exercise apparatus. The load-bearing mechanism includes an actuator, a position sensor, and a force sensor. A method for adjusting a relative distance between a loading interface and a user support of an exercise apparatus using a load-bearing mechanism to accommodate users of varying size. Exercise systems and related methods according to which a kiosk is in communication with one or more of the following: a grip-strength tester or component(s) thereof; a balance board or component(s) thereof; a vibration system or component(s) thereof; and/or other exercise devices or systems.

26 Claims, 19 Drawing Sheets

(52) U.S. Cl.
CPC ... *A63B 2208/0233* (2013.01); *A63B 2220/13* (2013.01); *A63B 2220/51* (2013.01); *A63B 2225/096* (2013.01)

(58) Field of Classification Search
CPC ..... A63B 23/1236; A63B 23/1209; A63B 24/0087; A63B 24/0062; A63B 2208/0233; A63B 2220/13; A63B 2220/51; A63B 2225/096
See application file for complete search history.

(56) References Cited

U.S. PATENT DOCUMENTS

| | | | | |
|---|---|---|---|---|
| 11,957,960 | B2 * | 4/2024 | Bissonnette ..... | A63B 21/4033 |
| 2018/0326242 | A1 | 11/2018 | Jaquish et al. | |
| 2020/0170873 | A1 | 6/2020 | Walsh et al. | |
| 2020/0353310 | A1 | 11/2020 | Bissonnette et al. | |
| 2020/0360219 | A1 * | 11/2020 | Benda ..... | A63B 21/00181 |

* cited by examiner

315c

EXERCISE SYSTEMS AND RELATED METHODS

CROSS-REFERENCE TO RELATED APPLICATIONS

This application claims the benefit of the filing date of, and priority to, U.S. Patent Application No. 63/256,351, filed Oct. 15, 2021, the entire disclosure of which is hereby incorporated herein by reference.

This application also claims the benefit of the filing date of, and priority to, U.S. Patent Application No. 63/270,344, filed Oct. 21, 2021, the entire disclosure of which is hereby incorporated herein by reference.

TECHNICAL FIELD

This application relates generally to an exercise apparatus and related method, and, more particularly, to an exercise apparatus including a load-bearing mechanism with an actuator, a position sensor, and a force sensor, and a method of operating same.

DETAILED DESCRIPTION

Figure 1:
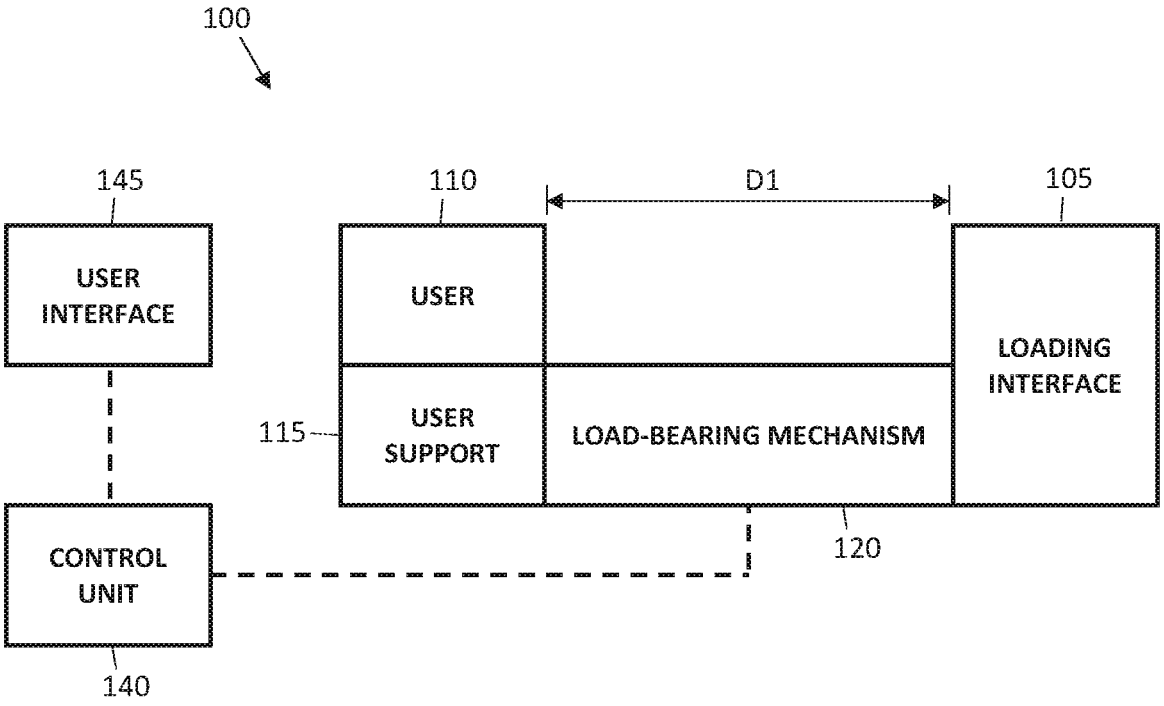
FIG. 1 is a diagrammatic illustration of an exercise apparatus in a first operational state or configuration, according to one or more embodiments.

Referring to FIG. 1, in an embodiment, an exercise apparatus is generally referred to by the reference numeral 100. The exercise apparatus 100 includes a loading interface 105, which loading interface 105 is adapted to receive a load from a user 110. In one or more embodiments, as in FIG. 1, the exercise apparatus 100 also includes a user support 115, which user support 115 is adapted to support the user 110 while the user 110 applies the load to the loading interface 105. During the application of the load by the user 110 to the loading interface 105, the user support 115 and the loading interface 105 are adapted to remain static relative to each other, thereby facilitating an isometric exercise in which particular muscle(s) or group(s) of muscle(s) are contracted without noticeably changing the length of the affected muscle(s) or moving the affected joint(s). A load-bearing mechanism 120 is operably coupled between the loading interface 105 and the user support 115. The load-bearing mechanism 120 is adapted to: adjust a relative distance between the loading interface 105 and the user support 115; detect the relative distance between the loading interface 105 and the user support 115; and detect the load applied to the loading interface 105 by the user 110. In one or more embodiments, the load-bearing mechanism 120 is part of the exercise apparatus 100.

Figure 2:
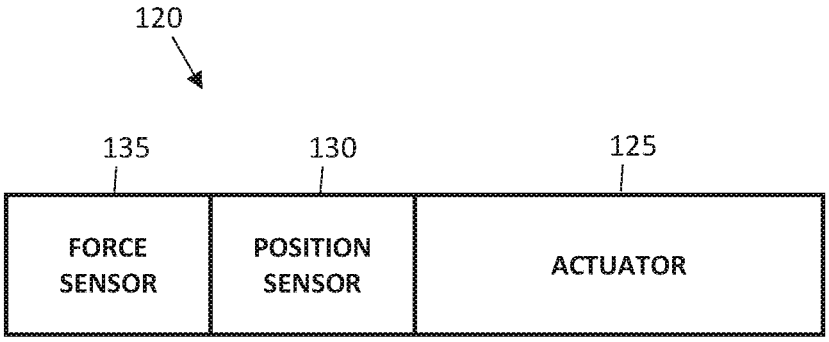
FIG. 2 is a diagrammatic illustration of a load-bearing mechanism of the exercise apparatus of FIG. 1, according to one or more embodiments.

Referring to FIG. 2, with continuing reference to FIG. 1, in an embodiment, to achieve the correct positioning of the affected muscle(s) and joint(s) of differently-sized users of the exercise apparatus 100 for the isometric exercise, the load-bearing mechanism 120 includes an actuator 125 (e.g., a linear actuator such as a screw-driven actuator), which actuator 125 is adapted to adjust the relative distance between the loading interface 105 and the user support 115. In one or more embodiments, during such adjustment, the loading interface 105 is dynamic, and the actuator 125 is operably coupled to the loading interface 105 to move the loading interface 105 relative to the user support 115, thereby adjusting the relative distance between the loading interface 105 and the user support 115. In addition, or instead, in one or more embodiments, during such adjustment, the user support 115 is dynamic, and the actuator 125 is operably coupled to the user support 115 to move the user support 115 relative to the loading interface 105, thereby adjusting the relative distance between the loading interface 105 and the user support 115.

The load-bearing mechanism 120 also includes a position sensor 130 and a force sensor 135. The position sensor 130 is adapted to detect the relative distance between the loading interface 105 and the user support 115. In one or more embodiments, the position sensor 130 provides the ability for the exercise apparatus 100 to adjust the relative distance between the user support 115 and the loading interface 105 by smaller increments than attainable by prior machines that did not include the position sensor 130, namely to 160 discrete positions within the same range as was previously only attainable to 16 discrete positions with prior machines. Additionally, the position sensor 130 provides improved positional accuracy as compared to prior machines. The force sensor 135 is adapted to detect the load applied to the loading interface 105 by the user 110. Turning back to FIG. 1, a control unit 140 is adapted to receive readings from the position sensor 130 and the force sensor 135, and to send control signals to the actuator 125, causing the actuator 125 to adjust the relative distance between the loading interface 105 and the user support 115. The control unit 140 communicates with a user interface 145 viewable by the user 110. In one or more embodiments, the user interface 145 is part of the control unit 140. In one or more embodiments, the control unit 140, the user interface 145, or both are part of the load-bearing mechanism 120.

Figure 3:
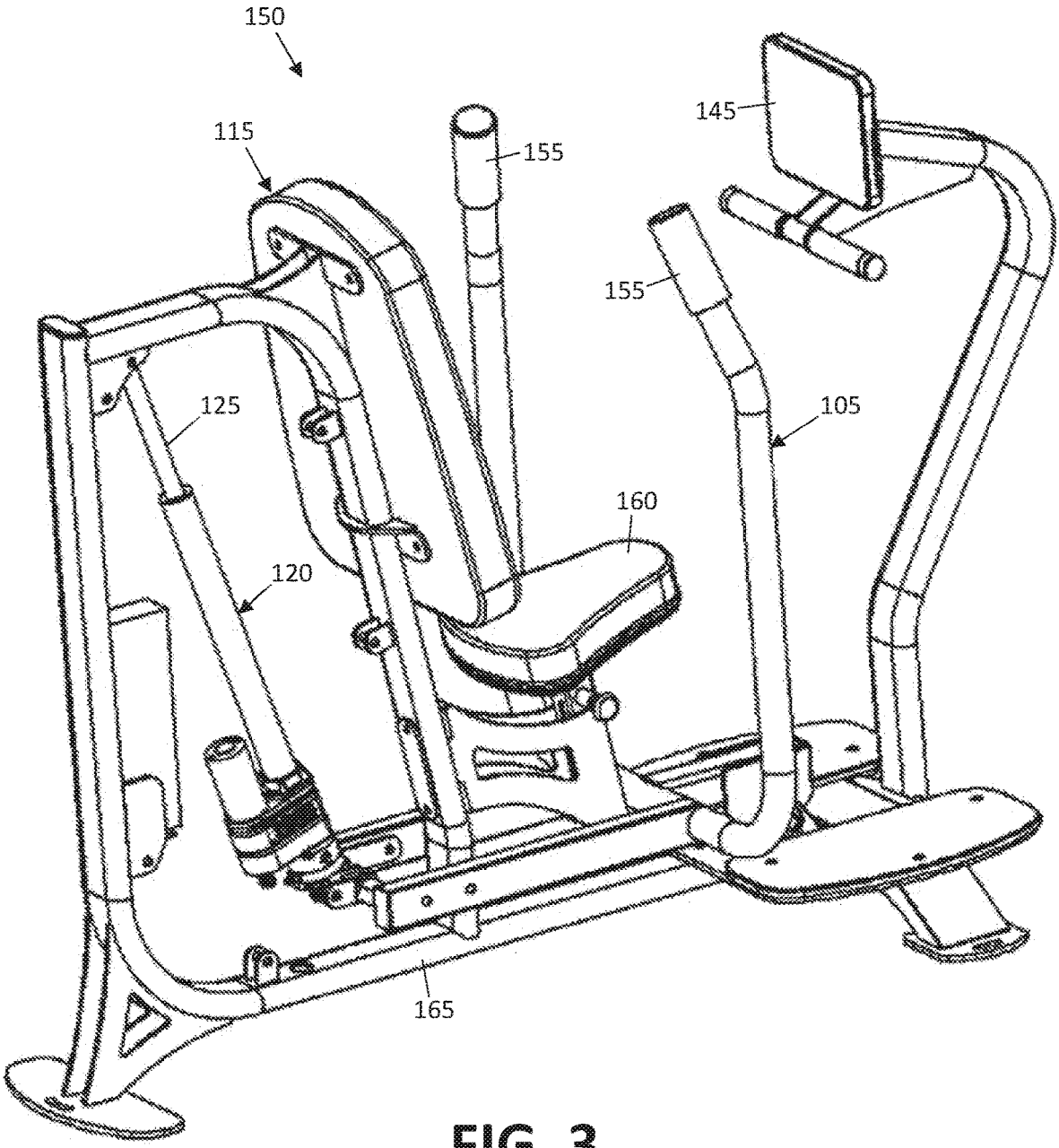
FIG. 3 is a perspective view of the exercise apparatus of FIG. 1, according to one or more embodiments.

Since the actuator 125 allows the load-bearing mechanism 120 to adjust the relative distance between the user support 115 and the loading interface 105, the load-bearing mechanism 120 can be installed in a variety of different types of exercise apparatuses. For example, referring to FIG. 3, with continuing reference to FIGS. 1 and 2, in an embodiment, the load-bearing mechanism 120 is installed in a chest press machine 150. The loading interface 105 of the chest press machine 150 is or includes handles 155 adapted to be gripped by the user 110's hands to apply the load. The user support 115 is or includes a seat 160 in which the user 110 sits while applying the load to the handles 155. The chest press machine 150 also includes a frame 165 to which both the handles 155 and the seat 160 are operably coupled. As shown in FIG. 3, the actuator 125 is adapted to move the handles 155 relative to the seat 160 while the seat 160 remains static to adjust the relative distance between the handles 155 and the seat 160 until the desired position has been achieved for the user 110 (e.g., ~120 degrees of bend at the affected joint, which in the case of the chest press machine 150 is the elbow).

Although illustrated in FIG. 3 as being installed into the chest press machine 150, the load-bearing mechanism of the present disclosure can also be installed into the various exercise apparatuses disclosed in U.S. Pat. No. 10,675,497, the entire disclosure of which is hereby incorporated herein by reference, and also disclosed in International Application No. PCT/US2016/052302, published as International Publication No. WO 2017/049198, the entire disclosures of which are hereby incorporated herein by reference. Other exercise apparatuses into which the load-bearing mechanism can be installed include, but are not limited to, chest press machines, leg press machines, core machines, vertical lift machines, the like, other exercise apparatuses, or any combination thereof.

Figure 4:
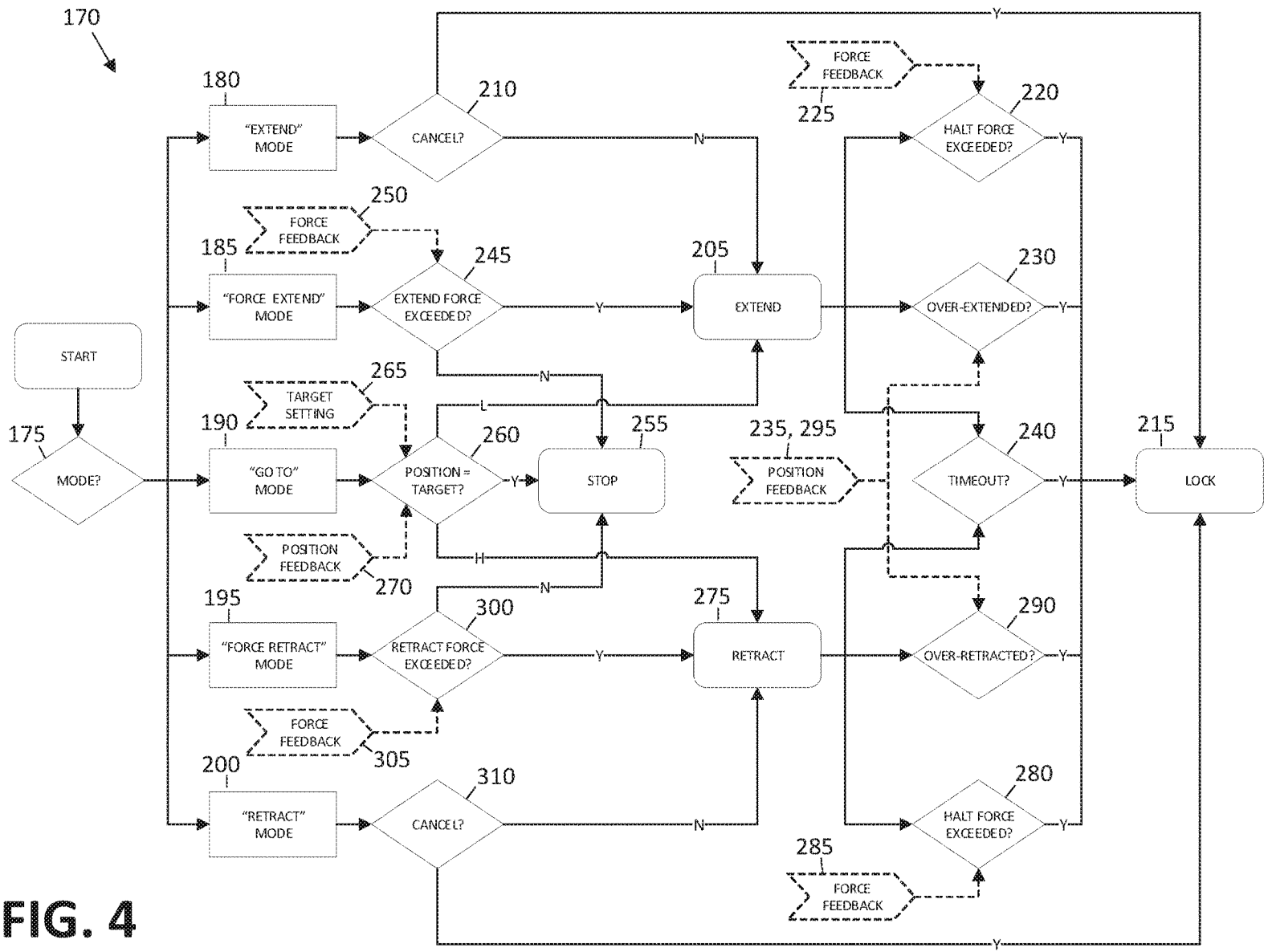
FIG. 4 is a flow diagram of a method for implementing one or more embodiments of the present disclosure.
Figure 5:
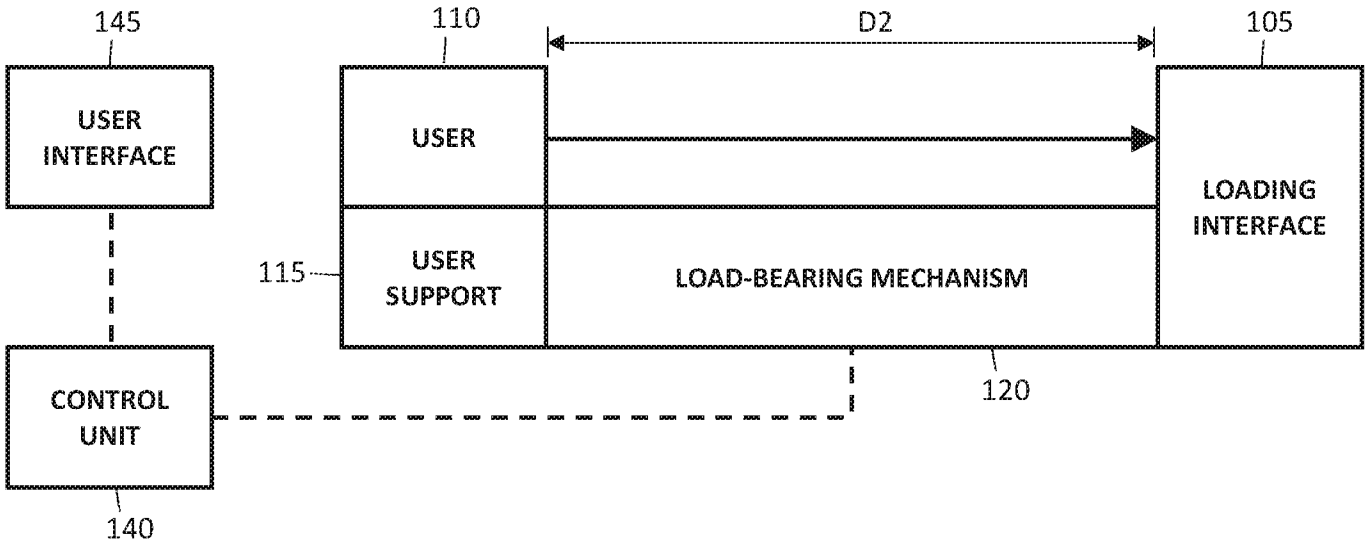
FIG. 5 is a diagrammatic illustration of the exercise apparatus of FIG. 1 in a second operational state or configuration, according to one or more embodiments.
Figure 6:
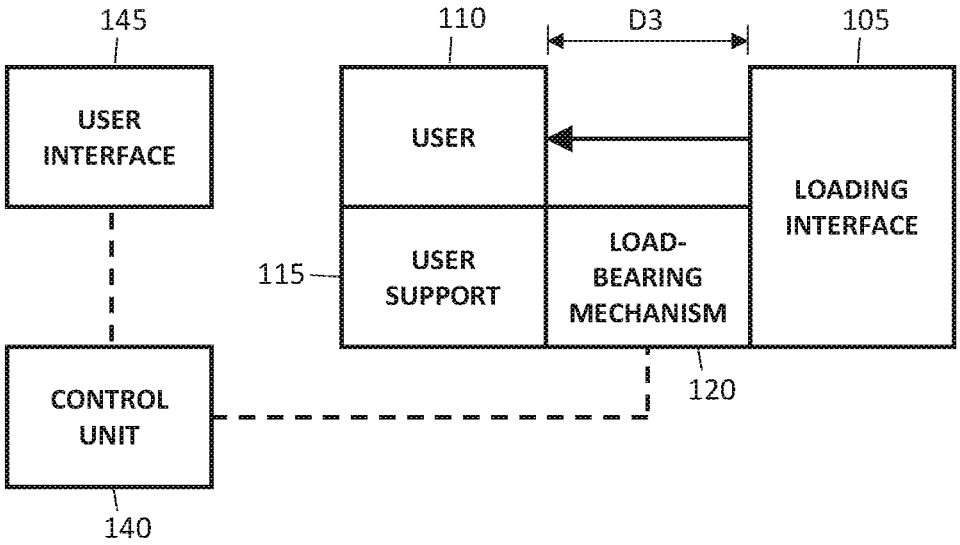
FIG. 6 is a diagrammatic illustration of the exercise apparatus of FIG. 1 in a third operational state or configuration, according to one or more embodiments.

Referring to FIG. 4, with continuing reference to FIGS. 1 through 3, in an embodiment, a method is generally referred to by the reference numeral 170. The method 170 generally includes at a step 175, selecting between: an "extend" mode 180; a "force extend" mode 185; a "go to" mode 190; a "force retract" mode 195; and a "retract" mode 200. Selecting the "extend" mode 180 at the step 175 permits the user 110 to enter an input (via push button, touch screen, the like, etc.) into the user interface 145 to extend the relative distance between the user support 115 and the loading interface 105 from a smaller distance to a larger distance, namely from D1 (shown in FIG. 1) to D2 (shown in FIG. 5), from D3 (shown in FIG. 6) to D1, or from D3 to D2. The distance D2 is greater than the distance D1, which, in turn, is greater than the distance D3. However, it is noted that the distances D1, D2, and D3 are merely illustrative, as the actuator 125 is capable of adjusting the exercise apparatus 100 to various other positions within its range of motion. At a step 205, in response to the user 110 entering the input into the user interface 145, the actuator 125 extends the relative distance between the user support 115 and the loading interface 105 from the smaller distance towards the larger distance. At a step 210, during the extension of the relative distance between the user support 115 and the loading interface 105, the user 110 can choose to cancel such extension by entering an input into the user interface 145. In response to the user 110 choosing to so cancel the extension, the actuator 125 is locked at a step 215. In such instances, the locking of the actuator 125 can simply stop movement of the actuator 125 until the user 110 enters a different input into the user interface 145 or selects another mode.

At a step 220, during the extension of the relative distance between the user support 115 and the loading interface 105, the force sensor 135 provides force feedback 225 to help determine whether an extension halt force threshold has been exceeded. Once it is determined from the force feedback 225 that the extension halt force threshold has been so exceeded, then the actuator 125 is locked at the step 215. In such instances, the locking of the actuator 125 can initially reverse movement of the actuator 125 by a given amount before stopping movement of the actuator 125, at least until the user 110 enters a different input into the user interface 145 or selects another mode. Such reverse movement allows the user 110 to remove any impingement from the exercise apparatus 100 that can have caused the extension halt force threshold to be exceeded. At a step 230, during the extension of the relative distance between the user support 115 and the loading interface 105, the position sensor 130 also provides position feedback 235 to help determine whether the relative distance between the user support 115 and the loading interface 105 has been over-extended. Once it is determined from the position feedback 235 that the relative distance has been so over-extended, then the actuator 125 is locked at the step 215. In such instances, the locking of the actuator 125 can reverse movement of the actuator 125 until the relative distance between the user support 115 and the loading interface 105 has been corrected. At a step 240, if it is determined that a time limit has been exceeded before the relative distance between the user support 115 and the loading interface 105 has been extended, then the actuator 125 is locked at the step 215.

Selecting the "force extend" mode 185 at the step 175 permits the user 110 to physically engage the loading interface 105 to extend the relative distance between the user support 115 and the loading interface 105 from the smaller distance to the larger distance. At a step 245, the force sensor 135 provides force feedback 250 to help determine whether the physical engagement of the user 110 with the loading interface 105 has exceeded a threshold extension force. Once it is determined from the force feedback 250 that the threshold extension force has been so exceeded, then the actuator 125 extends the relative distance between the user support 115 and the loading interface 105 from the smaller distance towards the larger distance at the step 205. During said extension, the actuator 125 can be locked at the step 215 in response to execution of the steps 220, 230, or 240, as previously discussed. Additionally, once, during said extension, it is determined from the force feedback 250 that the threshold extension force is no longer so exceeded, the actuator is stopped at a step 255. This feature allows the user 110 to "push" the loading interface 105 until the desired position is achieved, at which point the user 110 releases the loading interface 105. In some instances, the user 110 can then enter an input into the user interface 145 to indicate that the desired position has been achieved. This feature eliminates the need for the user 110 to approximate his or her size and estimate the appropriate corresponding setting on the exercise apparatus 100 prior to his or her first use, instead allowing the user 110 to simply engage the user support 115 and "push" on the loading interface 105 until the desired position is achieved (e.g., ~120 degrees of bend at the affected joint).

Selecting the "go to" mode 190 at the step 175 permits the user 110 to enter identifying information into the user interface 145, causing a previously-stored target setting associated with the user 110 to be provided. At a step 260, the position sensor 130 also provides position feedback 270 to help determine whether the relative distance between the user support 115 and the loading interface 105 matches the target setting 265. If it is determined from the position feedback 270 that the relative distance between the user support 115 and the loading interface 105 is smaller than the target setting 265, then the actuator 125 extends the relative distance at the step 205 until it matches the target setting 265. During said extension, the actuator 125 can be locked at the step 215 in response to execution of the steps 220, 230, or 240, as previously discussed. If, on the other hand, it is determined from the position feedback 270 that the relative distance between the user support 115 and the loading interface 105 is larger than the target setting 265, then the actuator 125 retracts the relative distance, at a step 275, until it matches the target setting 265.

At a step 280, during the retraction of the relative distance between the user support 115 and the loading interface 105, the force sensor 135 provides force feedback 285 to help determine whether a retraction halt force threshold has been exceeded. Once it is determined from the force feedback 285 that the retraction halt force threshold has been so exceeded, then the actuator 125 is locked at the step 215. In such instances, the locking of the actuator 125 can initially reverse movement of the actuator 125 by a given amount before stopping movement of the actuator 125, at least until the user 110 enters a different input into the user interface 145 or selects another mode. Such reverse movement allows the user 110 to remove any impingement from the exercise apparatus 100 that can have caused the retraction halt force threshold to be exceeded. At a step 290, during the retraction of the relative distance between the user support 115 and the loading interface 105, the position sensor 130 also provides position feedback 295 to help determine whether the relative distance between the user support 115 and the loading interface 105 has been over-retracted. Once it is determined from the position feedback 295 that the relative distance has been so over-retracted, then the actuator 125 is locked at the step 215. In such instances, the locking of the actuator 125 can reverse movement of the actuator 125 until the relative distance between the user support 115 and the loading interface 105 has been corrected. At the step 240, if it is determined that a time limit has been exceeded before the relative distance between the user support 115 and the loading interface 105 has been retracted, then the actuator 125 is locked at the step 215.

Selecting the "force retract" mode 195 at the step 175 permits the user 110 to physically engage the loading interface 105 to retract the relative distance between the user support 115 and the loading interface 105 from the larger distance to the smaller distance, namely from D2 (shown in FIG. 5) to D1 (shown in FIG. 1), from D1 to D3 (shown in FIG. 6), or from D2 to D3. At a step 300, the force sensor 135 provides force feedback 305 to help determine whether the physical engagement of the user 110 with the loading interface 105 has exceeded a threshold retraction force. Once it is determined from the force feedback 305 that the threshold retraction force has been so exceeded, then the actuator 125 retracts the relative distance between the user support 115 and the loading interface 105 from the larger distance towards the smaller distance at the step 275. During said retraction, the actuator 125 can be locked at the step 215 in response to execution of the steps 280, 290, or 240, as previously discussed. Additionally, once, during said retraction, it is determined from the force feedback 305 that the threshold retraction force is no longer so exceeded, the actuator is stopped at the step 255. This feature allows the user 110 to "pull" the loading interface 105 until the desired position is achieved, at which point the user 110 releases the loading interface 105. In some instances, the user 110 can then enter an input into the user interface 145 to indicate that the desired position has been achieved. This feature eliminates the need for the user 110 to approximate his or her size and estimate the appropriate corresponding setting on the exercise apparatus 100 prior to his or her first use, instead allowing the user 110 to simply engage the user support 115 and "pull" on the loading interface 105 until the desired position is achieved (e.g., ~120 degrees of bend at the affected joint).

Selecting the "retract" mode 180 at the step 200 permits the user 110 to enter an input (via push button, touch screen, the like, etc.) into the user interface 145 to retract the relative distance between the user support 115 and the loading interface 105 from the larger distance to the smaller distance. In response to the user 110 entering the input into the user interface 145, the actuator 125 retracts the relative distance between the user support 115 and the loading interface 105 from the larger distance towards the smaller distance at the step 275. During said retraction, the actuator 125 can be locked at the step 215 in response to execution of the steps 280, 290, or 240, as previously discussed. Additionally, at a step 310, during the retraction of the relative distance between the user support 115 and the loading interface 105, the user 110 can choose to cancel such retraction by entering an input into the user interface 145. In response to the user 110 choosing to so cancel the retraction, the actuator 125 is locked at the step 215. In such instances, the locking of the actuator 125 can simply stop movement of the actuator 125 until the user 110 enters a different input into the user interface 145 or selects another mode.

Figure 7A:
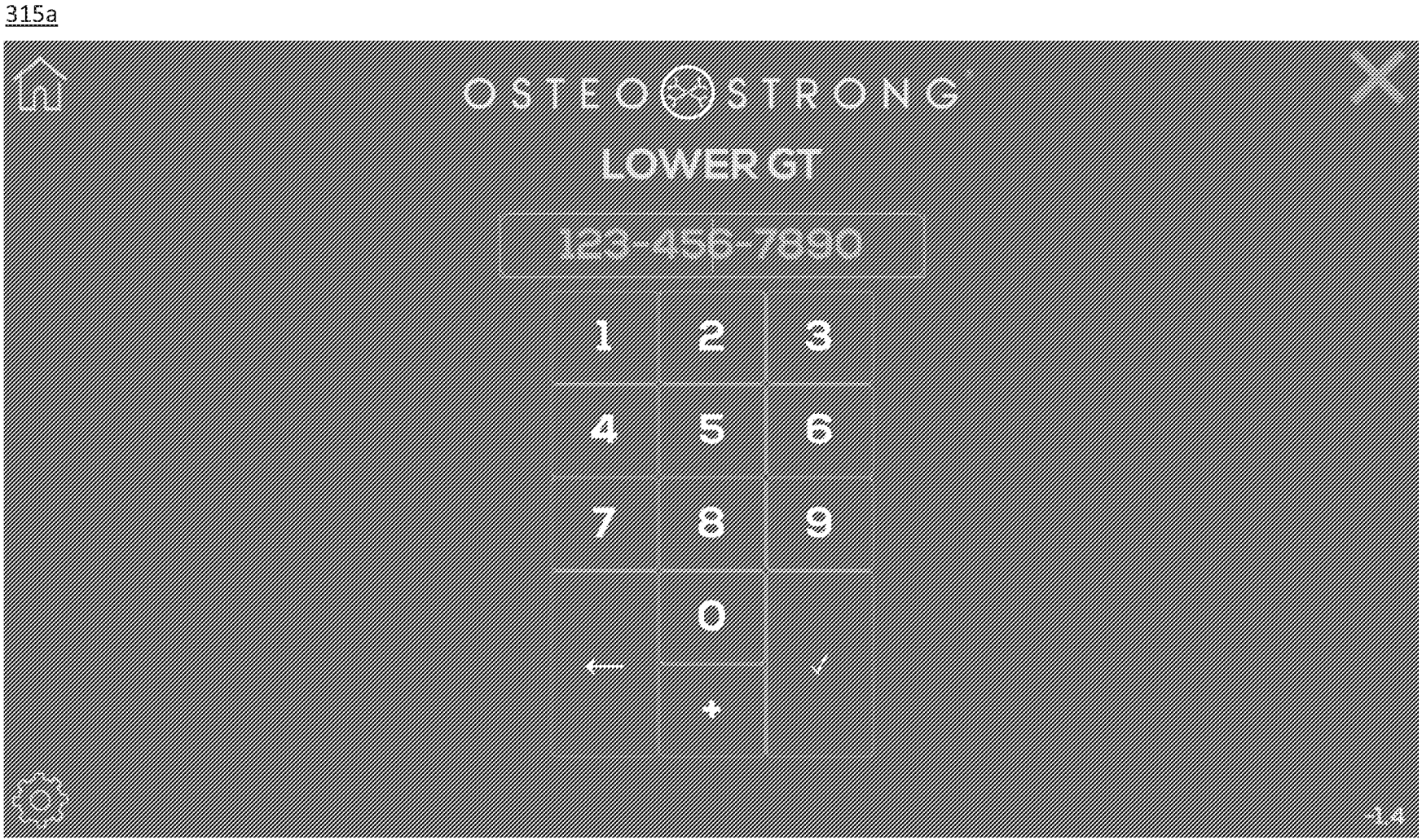
FIG. 7A is a graphical view of a first display pane of a user interface of the exercise apparatus of FIG. 1, which first display pane is displayed during at least a portion of the execution of the method of FIG. 4, according to one or more embodiments.
Figure 7B:
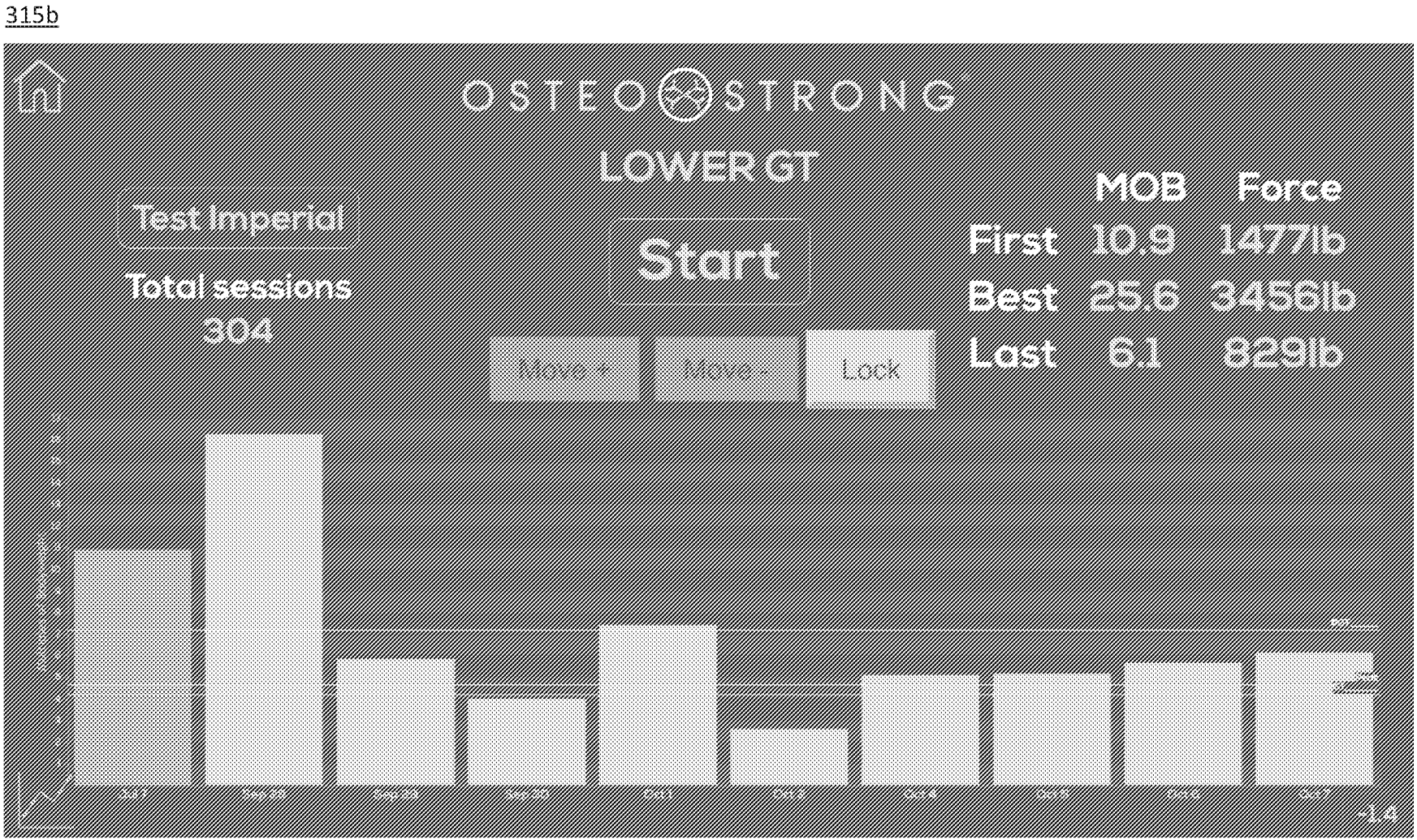
FIG. 7B is a graphical view of a second display pane of the user interface of the exercise apparatus of FIG. 1, which second display pane is displayed during at least a portion of the execution of the method of FIG. 4, according to one or more embodiments.
Figure 7C:
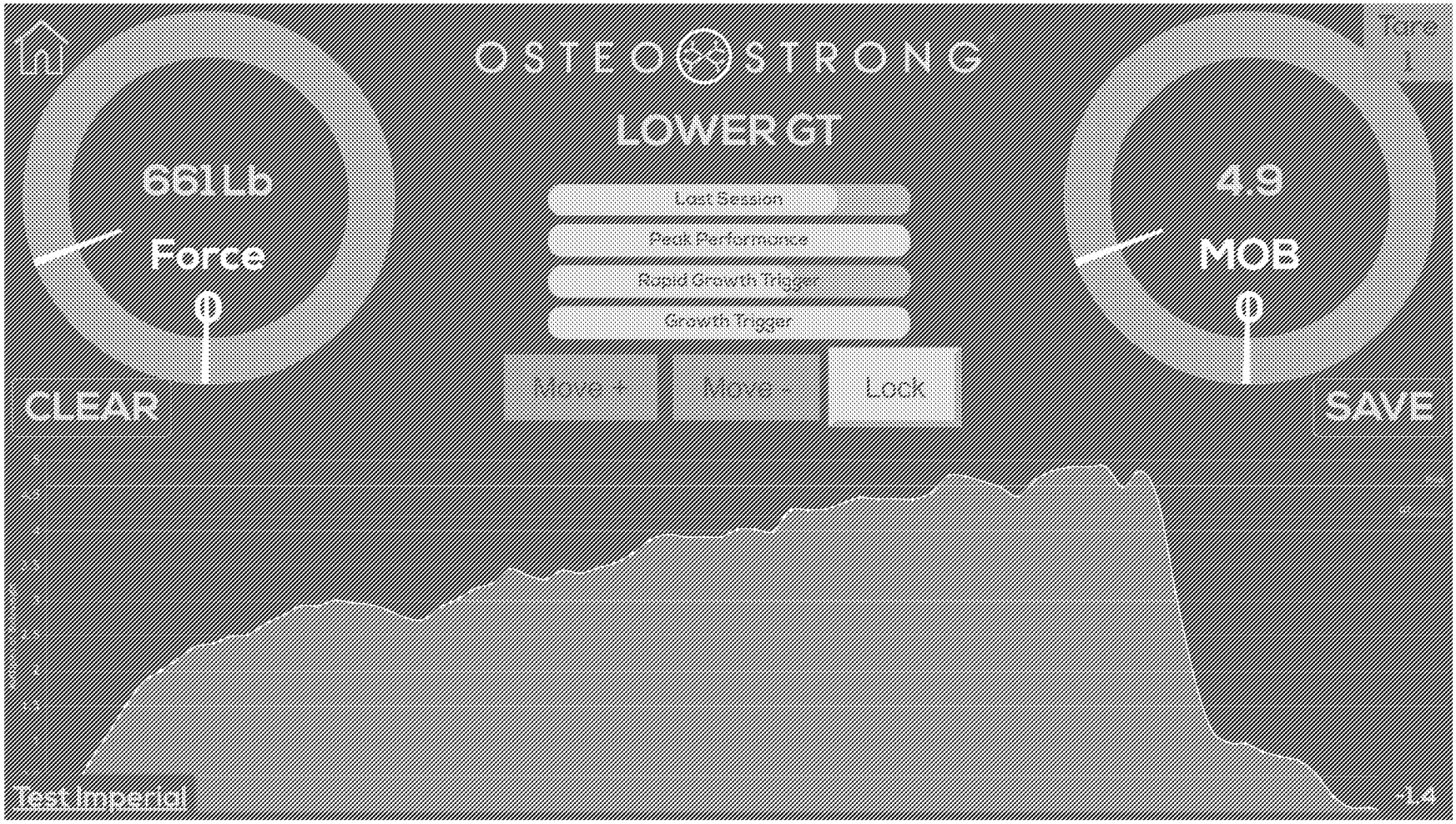
FIG. 7C is a graphical view of a third display pane of the user interface of the exercise apparatus of FIG. 1, which third display pane is displayed during at least a portion of the execution of the method of FIG. 4, according to one or more embodiments.
Figure 7D:
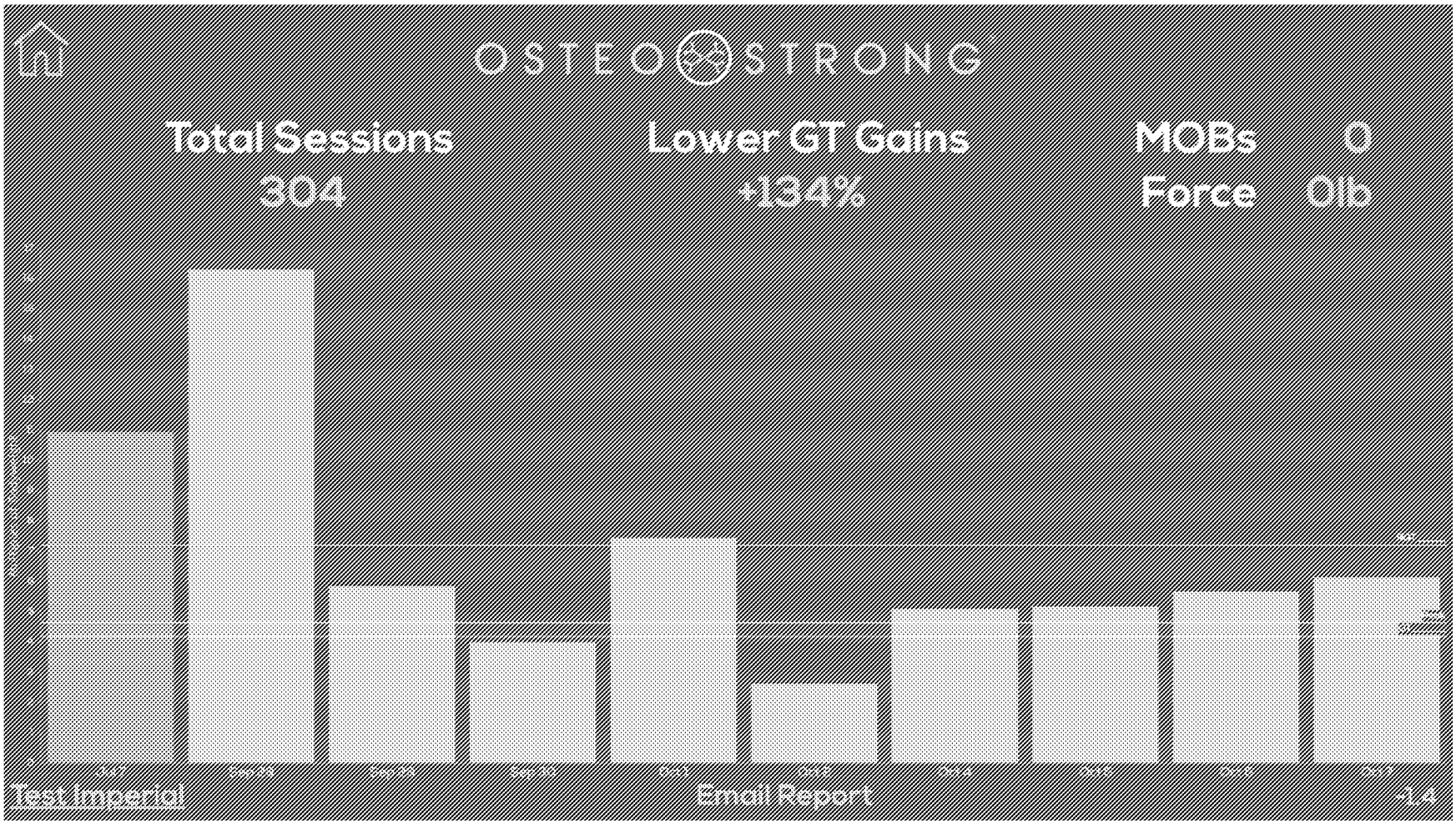
FIG. 7D is a graphical view of a fourth display pane of the user interface of the exercise apparatus of FIG. 1, which fourth display pane is displayed during at least a portion of the execution of the method of FIG. 4, according to one or more embodiments.

Referring to FIGS. 7A through 7D, with continuing reference to FIGS. 1 through 6, in an embodiment, various display panes 315*a-d* are illustrated, which are displayable on the user interface 145 before, during, or after execution of the method 170. FIG. 7A is a graphical view of the display pane 315*a* of the user interface 145, which display pane 315*a* is displayed before, during, or after at least a portion of the execution of the method 170. For example, in one or more embodiments, the display pane 315*a* is displayed in response to the user 110's selection of the "go to" mode 190 at the step 175, permitting the user 110 to enter identifying information into the user interface 145, which causes the previously-stored target setting associated with the user 110 to be provided, as previously discussed. FIG. 7B is a graphical view of the display pane 315*b* of the user interface 145, which display pane 315*b* is displayed before, during, or after at least a portion of the execution of the method 170. For example, in one or more embodiments, the display pane 315*b* illustrates session data from a number of previous sessions so that the user 110 can visualize his or her progress over time. FIG. 7C is a graphical view of the display pane 315*c* of the user interface 145, which display pane 315*c* is displayed before, during, or after at least a portion of the execution of the method 170. For example, in one or more embodiments, the display pane 315*c* illustrates session data from the current session, including a real-time reading from the force sensor 135 and a chart of said reading over the duration of the current session. FIG. 7D is a graphical view of the display pane 315*d* of the user interface 145, which display pane 315*d* is displayed before, during, or after at least a portion of the execution of the method 170. In one or more embodiments, the display pane 315*d* illustrates a report including session data from the current session (once completed) and a number of previous sessions so that the user 110 can visualize his or her progress over time. The user 110 may send the report to himself or herself (e.g., via email, SMS, or other) using the user interface 145.

Figure 8:
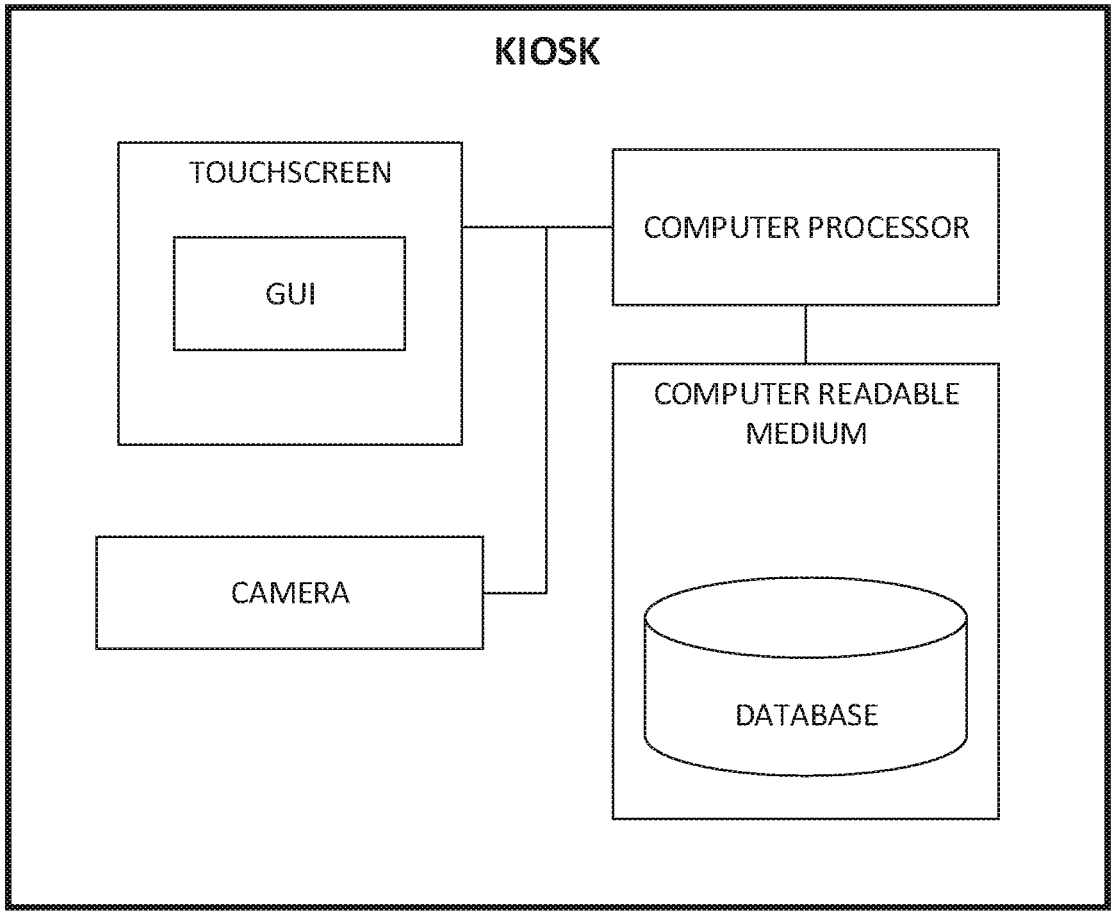
FIG. 8 is a diagrammatic illustration of a kiosk, according to one or more embodiments.

Referring to FIG. 8, a kiosk includes a touchscreen, a graphical user interface ("GUI"), a computer processor, and a computer readable medium operably coupled thereto. Instructions accessible to, and executable by, the computer processor are stored on the computer readable medium. A database is also stored in the computer readable medium. The database may store histories such as previous sessions and measurements of various users, video trainings, and the like. Generally, the GUI may display a plurality of windows or screens to the user 110. The user provides inputs via a screen that is displayed on the GUI. The kiosk also includes a microphone and a video camera as input devices, and an output device such as a speaker. The kiosk may run either rudimentary or advanced user interfaces. The kiosk includes selectable buttons, touch/video inputs, and data visualizations. The kiosk has standard inputs that include the camera, the microphone, weight inputs and force inputs via wireless or wired protocols.

In operation, the kiosk provides a station for the user 110 to access member services, as a self-service interface. The kiosk uses either facial recognition or personal information input to secure the kiosk. In some embodiments, both facial recognition and personal information input are used to secure the kiosk. The kiosk may use the facial recognition and/or personal information input to pull up a stored history of past sessions for the user 110. The stored history may include past services provided, past results of the services provided, and stored personal information. The kiosk displays a normalized GUI that acts as an introduction to regular, repeatable services. Once the user 110 is recognized or identified, the kiosk then checks the user 110 using one or more services, prior to walking them through a set of exercises or session goals. The kiosk provides any one or more of the following services: posture analysis, gait analysis, reach test, weighing the user 110, balance measurement, sit-to-stand effectiveness, grip strength test, pain-level records, review and introduction to external services, and the like. The kiosk thus urges the user 110 toward their personal health-space through engagement and reminder of their progress, by covering many data-points and provides a link between the data points in a compelling and meaningful way. The kiosk is designed to accept video and/or audio input. The user uses touch to select the selectable buttons.

In some embodiments, the kiosk is designed to generate new membership interest by functioning in a demonstration mode. In this demonstration mode, the kiosk is used to initiate a regular membership session. The kiosk may be used to do periodic updates and evaluations by collecting new measurements. The kiosk may also be used to conclude the regular membership session by providing a review and access to further, detailed information, which may include external communique.

In some embodiments, the kiosk may receive input and output signals for force measurements by wired or wireless means. The kiosk may also communicate with third-party devices via wired or wireless means. In some embodiments, the kiosk provides a detailed video analysis of a service. In some embodiments, the kiosk provides videos that walks the user 110 through the protocol of the session, the order of the session, and/or the proper form for an exercise for the session. In one or more embodiments, the kiosk incorporates resistance exercises as a service. In some embodiments, the kiosk suggests products or services based on the history and/or data profile of the user 110. In some embodiments, the kiosk allows a user to review previous sessions, since the kiosk stores the data of the user 110 for each session per service. The kiosk may operate as a self-service interface for the user, providing the user with consistent feedback and predictable interactions. In some embodiments, the touchscreen is a manufactured, vertical touchscreen.

Figure 9A:
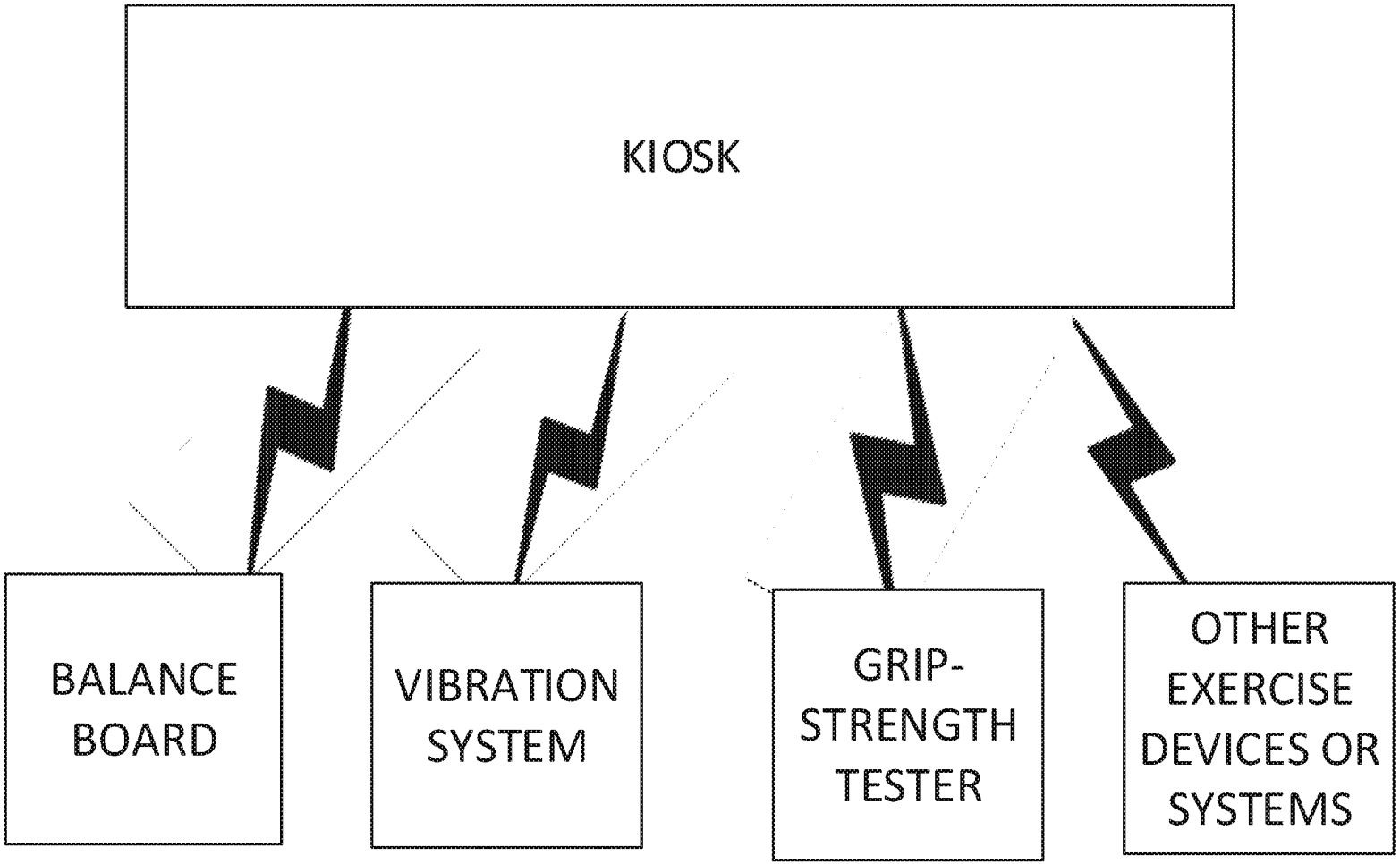
FIG. 9A is a diagrammatic illustration of a system including the kiosk of FIG. 8, according to one or more embodiments.
Figure 9B:
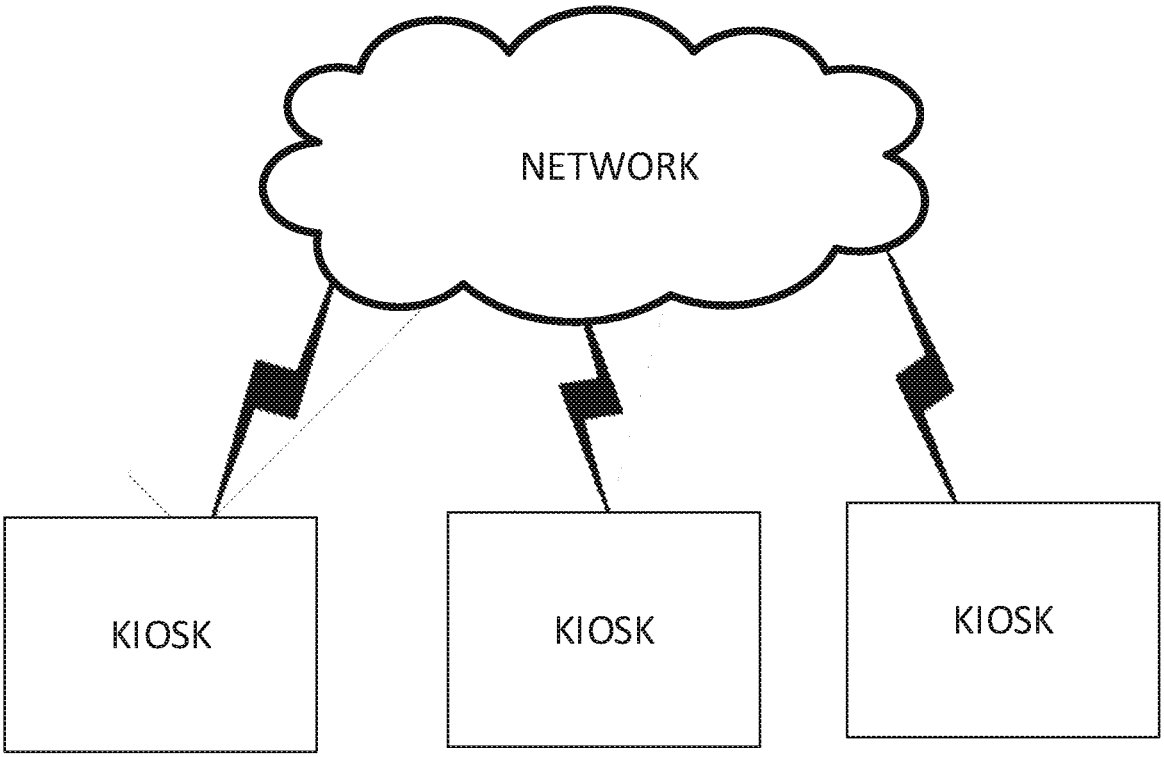
FIG. 9B is a diagrammatic illustration of a system including the kiosk of FIG. 8, according to one or more embodiments.

Referring to FIGS. 9A and 9B, the kiosk, in some embodiments, is in communication with a balance board or component(s) thereof, a vibration system or component(s) thereof, a grip-strength tester or component(s) thereof, and/or other exercise devices or systems. The kiosk may receive data, signals, and/or measurements from the balance board, the vibration system, the grip-strength tester, and/or the other exercise devices or systems. In some embodiments, the kiosk receives force measurements, weight measurements, and the like. In some embodiments, the kiosk sends preferred settings to the balance board, vibration system, the grip-strength tester, and/or the other exercise devices, specific to the user 110. As shown in FIG. 9B, the kiosk, in some embodiments, is in communication and/or networked with one or more kiosks. The kiosk may be networked with one or more kiosks at the same location such as a room or gym, or the kiosk can be networked with one or more kiosks in other locations (i.e., nationally, or globally). For example, if the user visits another location that has the respective exercise devices, the user may pull up his or her previous sessions and stored history at this kiosk. In some embodiments, the kiosk is in communication with a vibration controller. In some embodiments, the kiosk is in communication with a vibration machine. In some embodiments, the kiosk communicates with third-party devices to initiate external member services. In some embodiments, the kiosk informs the user 110 which services and/or exercise devices that the user 110 should use. In other embodiments, the kiosk is in communication with the one or more exercise devices in a room and/or center and locks the device(s) that the user 110 is not allowed to use. In some embodiments, the kiosk is operably coupled to one of the exercise devices or systems. In some embodiments, the kiosk is in communication with or operably coupled to multiple devices and/or machines in the room such that the kiosk may inform the user 110 or the respective exercise device to the user's desired settings, session goals, session preferences, and desired position on one or more devices or systems. In one or more embodiments, the user 110 may record using the kiosk a particular service and review an analysis related to that service. For example, the kiosk may record posture of the user 110 using the camera of the kiosk, while the user is on the balance board, and display a report related to the results of the posture and balance of the user 110. In some embodiments, the kiosk is integrated with other, third party services provided by the owner of the device.

Figure 10A:
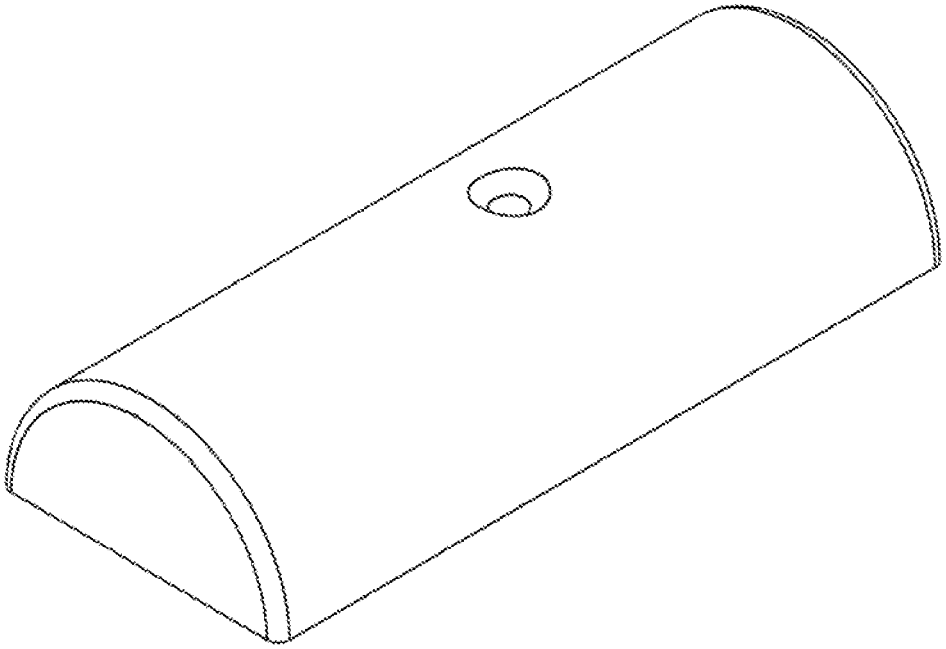
FIG. 10A is an isometric view of a portion of a grip-strength tester, according to one or more embodiments.
Figure 10B:
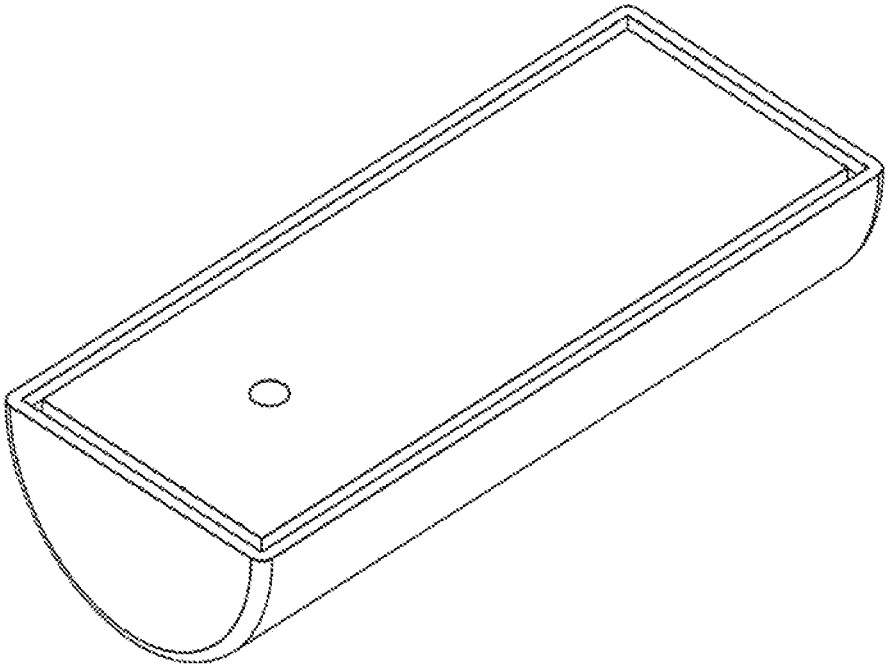
FIG. 10B is an isometric view of another portion of the grip-strength tester, according to one or more embodiments.
Figure 10C:
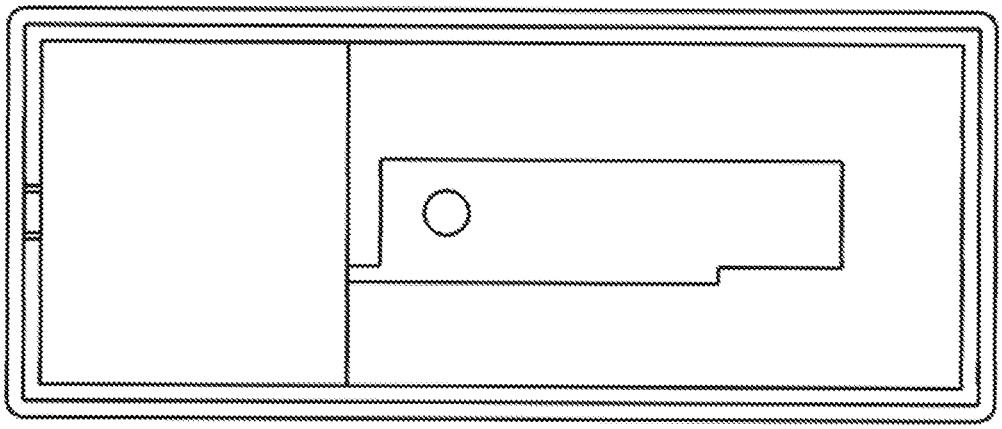
FIG. 10C is a bottom view of the portion of the grip-strength tester of FIG. 10A, according to one or more embodiments.
Figure 10D:
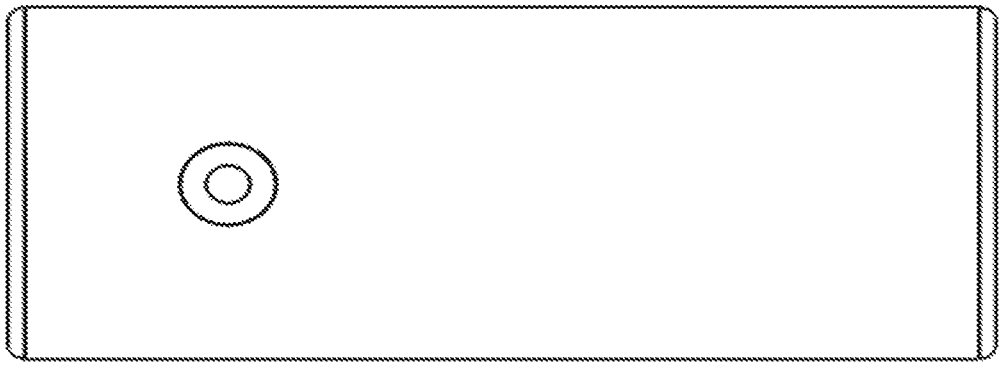
FIG. 10D is a bottom view of the portion of the grip-strength tester of FIG. 10B, according to one or more embodiments.
Figure 10E:
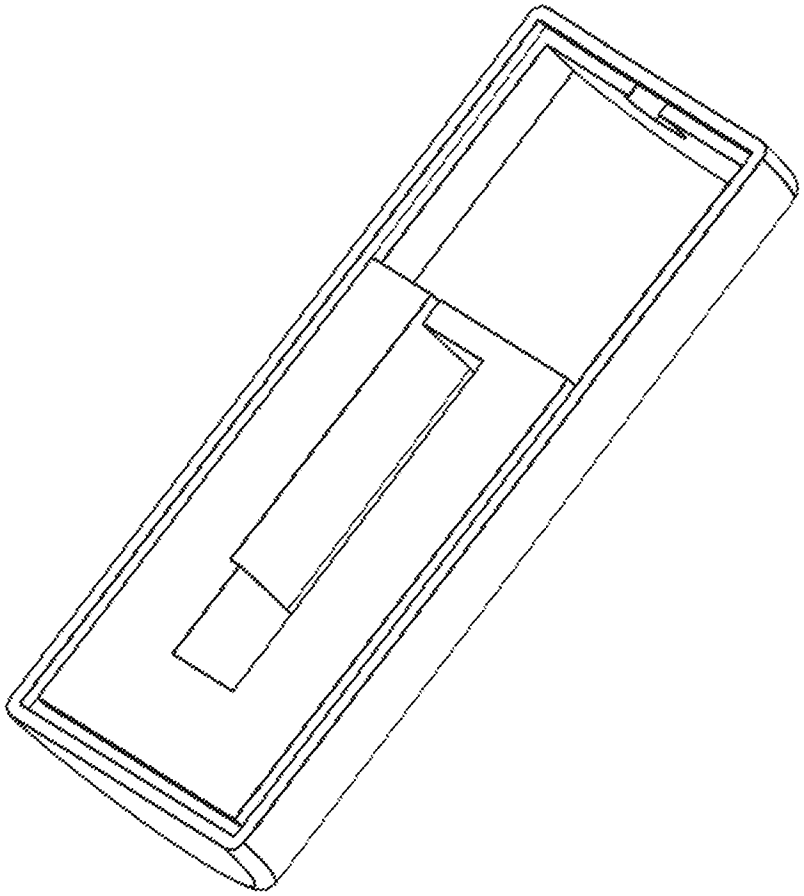
FIG. 10E is a perspective view of the portion of the of the grip-strength tester of FIG. 10A, according to one or more embodiments.

Referring to FIGS. 10A-10B, the grip-strength tester is shown having two half-cylindrical pieces. FIG. 10A depicts the top half-cylindrical piece, while FIG. 10B displays the bottom half-cylindrical piece. The two half-cylindrical pieces are connected by a force-measurement sensor bar. The two halves are aligned by a gasket. The two halves when combined form a cylindrical shape. FIG. 10C displays the bottom of the top half of the cylindrical piece, whereas FIG. 10D displays a bottom view of the bottom half of the cylindrical piece. Lastly, FIG. 10E depicts an internal volume of the top half of the cylindrical piece. The internal volume of the cylindrical grip-strength tester is used for storing the electronics. The electronics of the grip-strength tester decode, record, and transmit signal. The grip-strength tester is wireless. The grip-strength tester is portable.

In operation, the grip-strength tester is held in one hand by the user 110 and wirelessly registers the amount of force applied to the grip-strength tester. When the user 110 places pressure around the entire grip-strength tester (i.e., places pressure on both the halves) the force sensor is activated. The electronics inside the grip-strength tester decode, record, and transmit the signal, via wireless means. The grip-strength tester uses standard wireless protocols for integration into other services. The grip-strength tester sends the signal to the kiosk via wireless means. The kiosk, in some embodiments, receive force or pressure measurements. In some embodiments, the kiosk receives the signal from the grip-strength tester. In one or more embodiments, the kiosk stores and interprets the signal and/or data from the grip-strength tester and provides feedback and/or recommendations to the user 110. In some embodiments, the kiosk stores the signals for the specific user 110 over time so that the user 110 may see the improvement he or she is making over time. In some embodiments, once the kiosk recognizes the user 110 and pulls up their stored history, the kiosk requires that the user 110 use the grip-strength tester to perform a strength check prior to exercising and prior to the kiosk walking them through their upcoming session. In some embodiments, the grip-strength tester is integrated into another piece of exercise equipment. In some embodiments, the grip-strength tester is wired to the kiosk. In some embodiments, the bottom half of the cylindrical piece has an internal volume to store electronics. In other embodiments, both halves of the cylindrical piece have an internal volume to store electronics. In some embodiments, the halves are connected using a fastener. In some embodiments, the grip-strength tester is called smart-grip. In some embodiments, the grip-strength tester includes smart-grip.

Figure 11A:
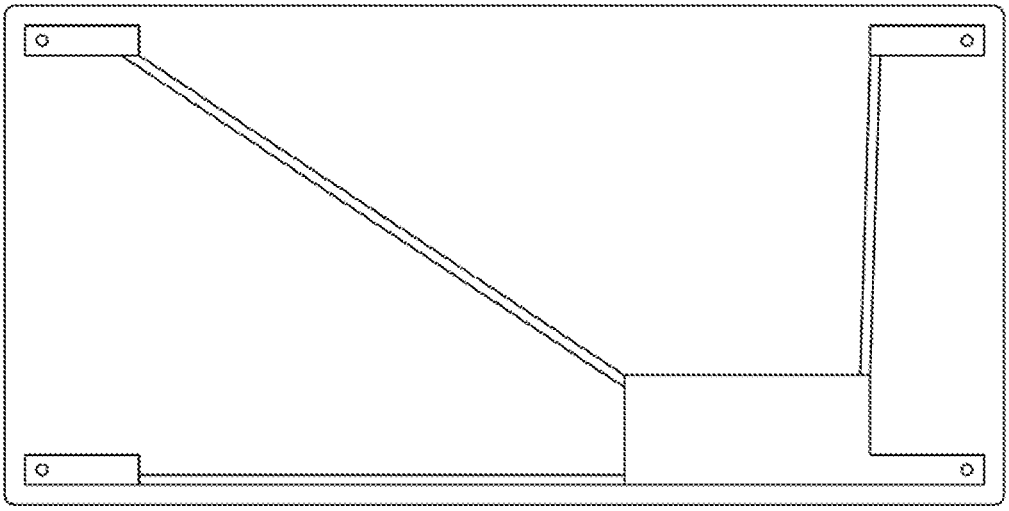
FIG. 11A is a top view of a base board of a balance board, according to one or more embodiments.
Figure 11B:
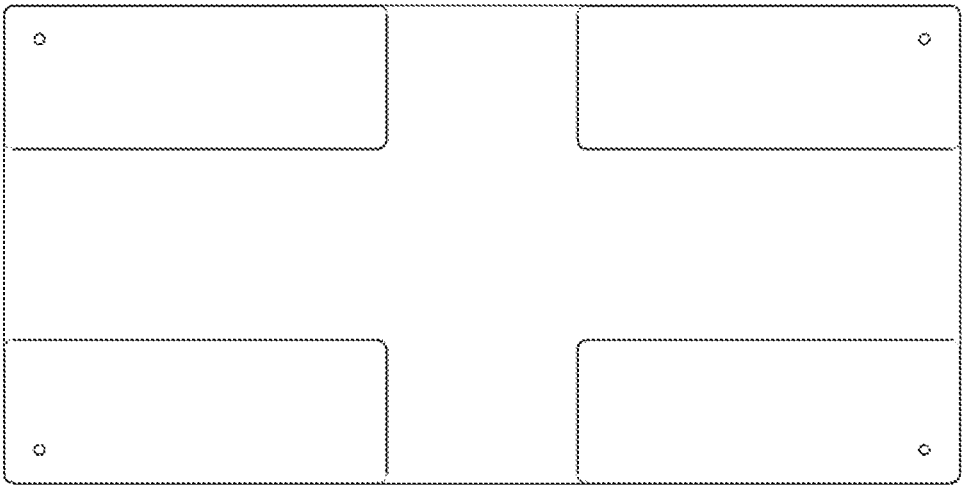
FIG. 11B is a bottom view of the base board of FIG. 11A, according to one or more embodiments.
Figure 11C:
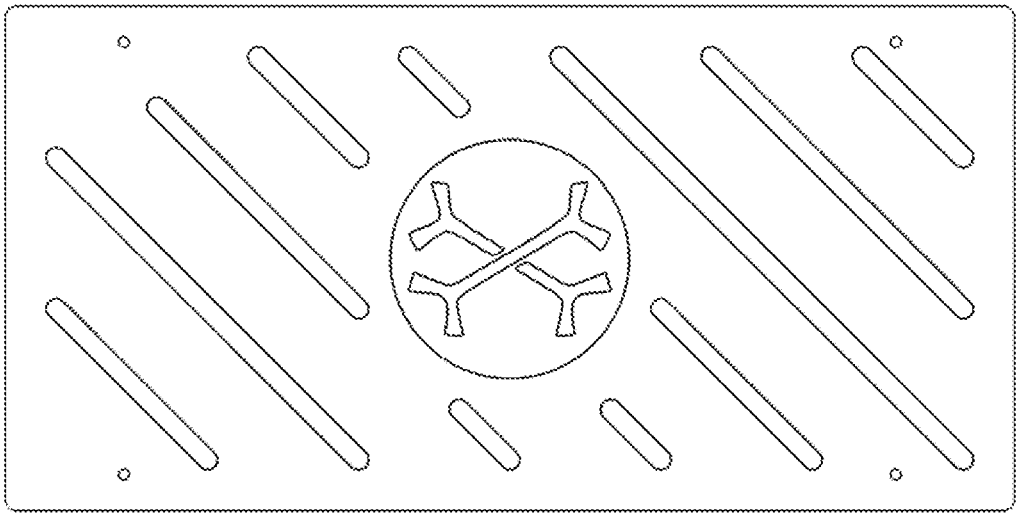
FIG. 11C is a top view of a foot plate of the balance board, according to one or more embodiments.
Figure 11D:
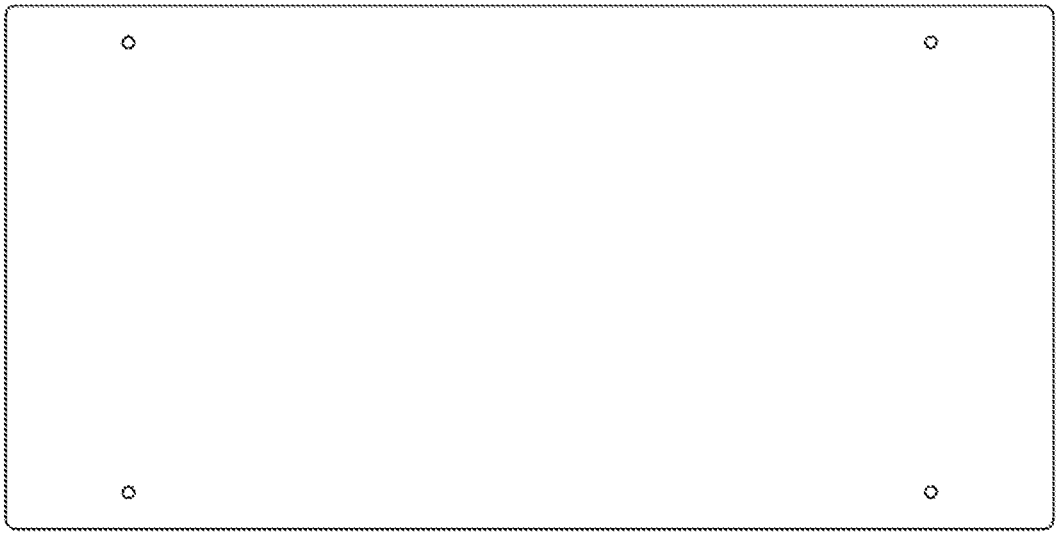
FIG. 11D is a bottom view of the foot plate of FIG. 11C, according to one or more embodiments.

Referring to FIGS. 11A-11D, the balance board includes a base board and a foot plate. The base board is shown in FIGS. 11A and 11B. The foot plate is shown in FIGS. 11C and 11D. The foot plate is coupled to the base board. The balance board is primarily two pieces connected at four connection points. Each connection point has a force-measurement sensor. Each connection point has wires that connect it to a cavity, and the cavity stores the necessary electronics, which read the amount of force that was exerted on the sensor(s) and sends the force measurements to the kiosk. The balance board houses the necessary electronics inside the cavity of the base board of the balance board. Referring to FIG. 11A, the four connection points or four force-measurement sensors can be seen each connecting to one area that stores the necessary electronics. The force-measurements are connected via wires to the necessary electronics, using a series of channels to house the wires. FIG. 11A displays the top of the base board of the balance board, whereas FIG. 11B displays the bottom of the base board of the balance board. The bottom of the base board of the balance board is placed on a floor. FIG. 11B shows that the balance board has significant material removed along two axes to aid in weight reduction of the balance board. The balance board also has a cutout designed to aid in carrying the device, as well as, stowing the device away. Therefore, the balance board is portable. Referring to FIGS. 11C and 11D, the foot plate is shown in the top and bottom view, respectively. The foot plate is placed on top of the base board, such that the user 110 would stand on the foot plate seen in FIG. 11C. The bottom of the foot plate, as seen in FIG. 11D, would be placed on top of the base plate, as seen in FIG. 11A, and secured thereto. The holes in the base board and the foot plate provide a means for alignment, as well as a means for securing the two together. In some embodiments, four screws are used to secure the base board and the foot plate together. In other embodiments, other fastening means are used to secure the base board and the foot plate together. The balance board is wireless. The size of the balance board enables it to be moved easily without changing the wiring.

In operation, the balance board is a device designed to bear weight and measure the deflection of that weight against the balance board's largest surface. The user 110 stands on the balance board. The balance board may detect the compression based on the weight of the user 110 or may measure the weight of the user 110, using the force measurement sensors. The measurements taken by the balance board are sent to the kiosk to be stored as the results of the user 110. The balance board can measure at least one or more of: the weight(s) of something resting on it; how much and to which direction the weight is leaning, and also the compression of the balance board. The balance board may measure weight by the user 110 standing on the balance board. The balance of the user 110 is measured by implementing multiple force-measurement sensors. Resistance and/or compression is measured by how the balance board responds to the compression of the balance board. The balance board sends its measurements, data, and/or signals to the kiosk. The kiosk is designed to receive the balance boards measurements, data, and/or signals via wired or wireless means. The kiosk also may receive force measurements from the balance board. The kiosk then may record the measurements, data, and/or signals to store that as a service result. The kiosk may then provide the user 110 with a stored history of service results from the balance board so that the user 110 may determine strengths, weakness, areas of improvement, and areas needing improvement.

In some embodiments, the balance board does not have a cutout portion. In other embodiments, the balance board has a different cutout portion. In some embodiments, the cutout portion is directly under the force measurement sensors. In some embodiments, the necessary electronics includes a processor. In some embodiments, the force-measurement sensor is a strain gauge. In some embodiments, the balance board may determine if the user 110 is off-balance or if the user 110 has poor posture based on how the user is leaning on the balance board. In some embodiments, a resistance band or strap is placed around the balance board and controlled by the user 110 atop the balance board, and the balance board may wireless send the compression measurements. In some embodiments, the one or more measurements taken by the balance board are sent to the kiosk. The kiosk, then, may instruct the user 110 on areas for improvement, instructional videos to improve their form, and/or statistics related to the current and previous sessions. In some embodiments, once the kiosk recognizes the user 110 and pulls up their stored history, the kiosk requires that the user 110 use the balance board to perform some health checks prior to exercising and prior to the kiosk walking them through their upcoming session. In some embodiments, the balance board works in conjunction with the kiosk to provide information on one or more of: posture, balance, gait analysis, and the like. In some embodiments, the kiosk takes a video of the user and compares the video information with the data being measured by the balance board to provide feedback to the user 110.

Figure 12:
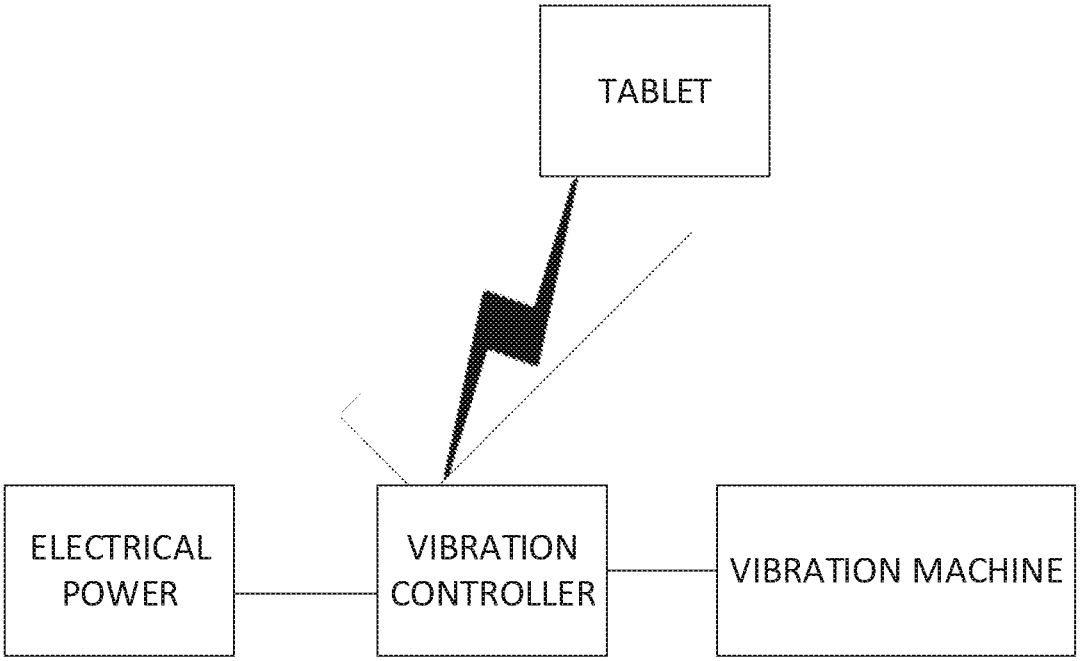
FIG. 12 is a diagrammatic illustration of a vibration system, according to one or more embodiments.

Referring to FIG. 12, the vibration system is shown. The vibration system includes the vibration controller, the vibration machine, and an electrical power supply. The vibration controller is a wireless controller for turning on or off a connected device by switching its electrical power. The vibration controller is, specifically used for turning on or off electrical power to the vibration machine. The vibration controller is a standard AC power plug that contains integrated electronics to switch the electrical power on and off. The vibration machine plugs into a normal AC outlet. Therefore, the vibration machine is plugged into the vibration controller. The vibration controller also includes a micro-controller that has wireless capability. The vibration controller or component(s) thereof are in communication with a tablet. The tablet has selectable buttons or icons to select whether the vibration controller turns on or off the electrical power to the vibration machine.

In operation, the vibration controller uses a Bluetooth wireless signal to switch on and off the electrical power of a connected device. The vibration controller enables integral safety mechanisms for the protection of the hardware or devices and the user 110. One benefit of the vibration controller is that this device allows the controls to be placed inconspicuously and controlled from a remote interface (i.e., the tablet). The vibration machine uses varying frequencies and/or amplitudes to train the user 110 in order to increase bone mineral density of the user 110. The user 110 may sit, stand, or exercise such as by performing squats or pushups on the vibration machine while the machine is running. The vibration machine requires a safety to avoid quick on/off power signals. Therefore, the vibration controller enables safety features specific to the vibration machine. The vibration controller, in some embodiments, recalls and implements settings particular to the user 110. The tablet allows a manager or the user 110 to control the vibration controller and thus, control the power to the vibration machine remotely.

In some embodiments, the vibration controller is used for another device or system to turn on/off the electrical power of the machine. In some embodiments, the vibration controller in communication with the tablet may also control settings related to the vibration machine such as frequency, amplitude, or force of the vibration machine, length of time for the vibration machine to be on, when the settings will vary, etc. In some embodiments, the user 110 or a manager selects custom settings specific to the user 110 to be implemented by the vibration controller. In some embodiments, a custom interface is built for other devices, using the vibration controller, employed by the user 110 for the ease of interfacing with standard wireless protocols. The vibration controller may use Bluetooth, Wi-Fi, or other wireless or wired means. In some embodiments, the vibration controller controls the vibration plate of the vibration machine. In some embodiments, the tablet is the kiosk, a remote computer, mobile device, or the like. In some embodiments, the vibration controller is called the vibration-plate controller; and the vibration machine is referred to as the vibration platform. In some embodiments, the vibration machine includes the vibration platform and/or a vibration plate. In some embodiments, the user 110 may be asked to stand on one foot, and then the other to measure the balance of the user 110. In other embodiments, this exercise is done on the balance board. The vibration machine, in some embodiments, varies the amplitude and/or frequency of vibration to test the user 110.

In some embodiments, once the kiosk recognizes the user 110 and pulls up their stored history, the kiosk requires that the user 110 use the vibration machine, the balance board, or the grip-strength tester to perform some health checks prior to exercising and prior to the kiosk walking them through their upcoming session. In one or more embodiments, once the kiosk recognizes the user 110 and pulls up their stored history, the kiosk requires that the user complete one or more of: a balance test using the balance board; a grip test using the grip-strength tester; and one or more tests on the vibration machine, and then the kiosk walks the user 110 through their results and session.

Figure 13:
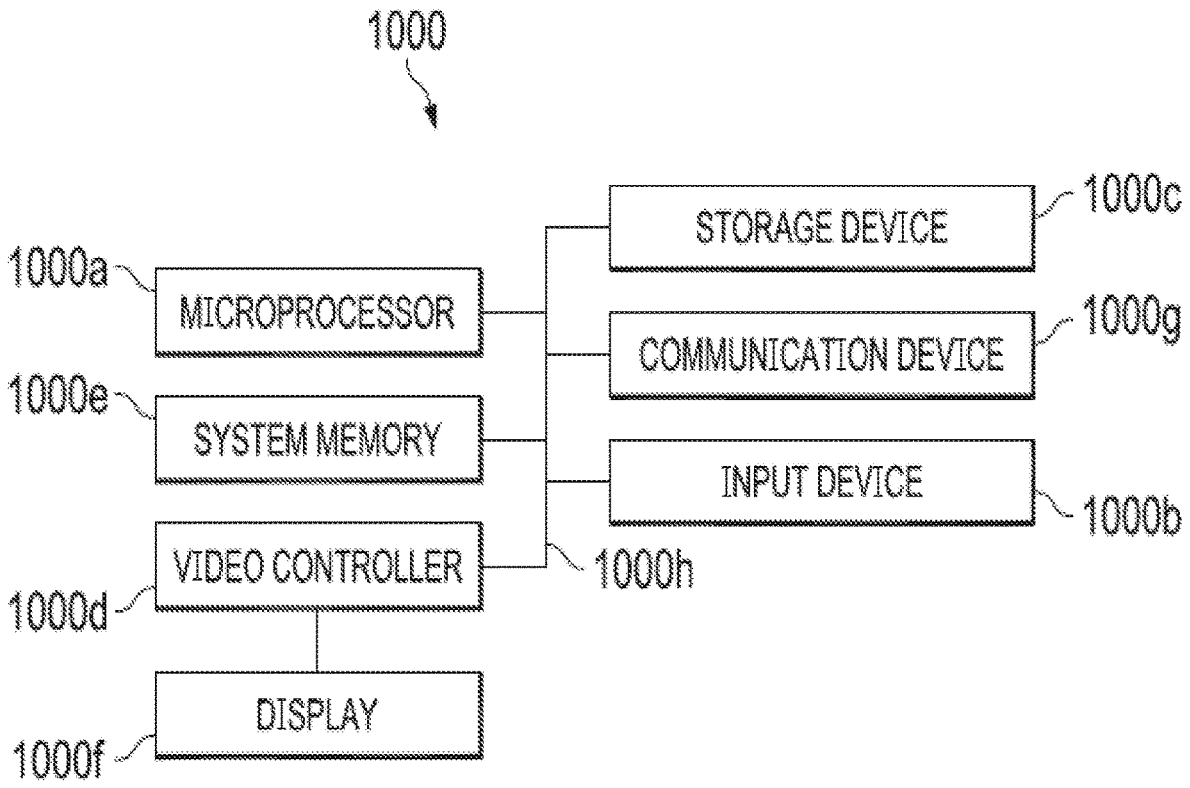
FIG. 13 a diagrammatic illustration of a computing node for implementing one or more embodiments of the present disclosure.

Referring to FIG. 13, with continuing reference to FIGS. 1 through 12, an illustrative node 1000 for implementing embodiment(s) of one or more of the control unit(s) (e.g., the control unit 140), controller(s), element(s), apparatus, system(s), method(s) (e.g., the method 170), step(s), or any combination thereof, described above and/or illustrated in FIGS. 1 through 12, is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In one or more embodiments, the storage device 1000*c* may include a hard drive, CD-ROM, optical drive, any other form of storage device and/or any combination thereof. In one or more embodiments, the storage device 1000*c* may include, and/or be capable of receiving, a CD-ROM, DVD-ROM, or any other form of non-transitory computer-readable medium that may contain executable instructions. In one or more embodiments, the communication device 1000*g* may include a modem, network card, or any other device to enable the node 1000 to communicate with other node(s). In one or more embodiments, the node and the other node(s) represent a plurality of interconnected (whether by intranet or Internet) computer systems, including without limitation, personal computers, mainframes, PDAs, smartphones and cell phones.

In some implementations, one or more of the embodiments described above and/or illustrated in FIGS. 1 through 12 include at least the node 1000 and/or components thereof, and/or one or more nodes that are substantially similar to the node 1000 and/or components thereof. In some implementations, one or more of the above-described components of the node 1000 and/or the embodiments described above and/or illustrated in FIGS. 1 through 12 include respective pluralities of same components.

In some implementations, one or more of the embodiments described above and/or illustrated in FIGS. 1 through 12 include a computer program that includes a plurality of instructions, data, and/or any combination thereof; an application written in, for example, Arena, HyperText Markup Language (HTML), Cascading Style Sheets (CSS), JavaScript, Extensible Markup Language (XML), asynchronous Javascript and XML (Ajax), and/or any combination thereof; a web-based application written in, for example, Java or Adobe Flex, which in one or more embodiments pulls real-time information from one or more servers, automatically refreshing with latest information at a predetermined time increment; or any combination thereof.

In one or more embodiments, a computer system typically includes at least hardware capable of executing machine readable instructions, as well as the software for executing acts (typically machine-readable instructions) that produce a desired result. In one or more embodiments, a computer system may include hybrids of hardware and software, as well as computer sub-systems.

In one or more embodiments, hardware generally includes at least processor-capable platforms, such as client-machines (also known as personal computers or servers), and hand-held processing devices (such as smart phones, tablet computers, or personal computing devices (PCDs), for example). In one or more embodiments, hardware may include any physical device that is capable of storing machine-readable instructions, such as memory or other data storage devices. In one or more embodiments, other forms of hardware include hardware sub-systems, including transfer devices such as modems, modem cards, ports, and port cards, for example.

In one or more embodiments, software includes any machine code stored in any memory medium, such as RAM or ROM, and machine code stored on other devices (such as floppy disks, flash memory, or a CD-ROM, for example). In one or more embodiments, software may include source or object code. In one or more embodiments, software encompasses any set of instructions capable of being executed on a node such as, for example, on a client machine or server.

In one or more embodiments, combinations of software and hardware could also be used for providing enhanced functionality and performance for certain embodiments of the present disclosure. In an embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In one or more embodiments, computer readable media include, for example, passive data storage, such as a random-access memory (RAM) as well as semi-permanent data storage such as a compact disk read only memory (CD-ROM). One or more embodiments of the present disclosure may be embodied in the RAM of a computer to transform a standard computer into a new specific computing machine. In one or more embodiments, data structures are defined organizations of data that may enable an embodiment of the present disclosure. In an embodiment, a data structure may provide an organization of data, or an organization of executable code.

In one or more embodiments, any networks and/or one or more portions thereof may be designed to work on any specific architecture. In an embodiment, one or more portions of any networks may be executed on a single computer, local area networks, client-server networks, wide area networks, internets, hand-held and other portable and wireless devices and networks.

In one or more embodiments, a database may be any standard or proprietary database software. In one or more embodiments, the database may have fields, records, data, and other database elements that may be associated through database specific software. In one or more embodiments, data may be mapped. In one or more embodiments, mapping is the process of associating one data entry with another data entry. In an embodiment, the data contained in the location of a character file can be mapped to a field in a second table. In one or more embodiments, the physical location of the database is not limiting, and the database may be distributed. In an embodiment, the database may exist remotely from the server, and run on a separate platform. In an embodiment, the database may be accessible across the Internet. In one or more embodiments, more than one database may be implemented.

In one or more embodiments, one or more of the above-described methods are executed, at least in part, using a proportional-integral-derivative (PID) control system, a PID controller, other type(s) of control systems, other type(s) of controllers, or any combination thereof. In one or more embodiments, the control unit 140 is, includes, or is part of, a PID controller, a PID control system, other type(s) of controllers, or any combination thereof.

In one or more embodiments, a plurality of instructions stored on a non-transitory computer readable medium may be executed by one or more processors to cause the one or more processors to carry out or implement in whole or in part embodiment(s) of one or more of the control unit(s) (e.g., the control unit 140), controller(s), element(s), apparatus, system(s), method(s) (e.g., the method 170), step(s), or any combination thereof, described above and/or illustrated in FIGS. 1 through 12. In one or more embodiments, such a processor may include one or more of the microprocessor 1000*a*, any processor(s) that are part of the components of the exercise apparatus 100 (e.g., the control unit 140), the load-bearing mechanism 120, and/or any combination thereof, and such a computer readable medium may be distributed among one or more components. In one or more embodiments, such a processor may execute the plurality of instructions in connection with a virtual computer system. In one or more embodiments, such a plurality of instructions may communicate directly with the one or more processors, and/or may interact with one or more operating systems, middleware, firmware, other applications, and/or any combination thereof, to cause the one or more processors to execute the instructions.

A method has been disclosed. The method generally includes: adjusting, using an actuator of a load-bearing mechanism, a relative distance between a user support and a loading interface of an exercise apparatus to thereby accommodate a user; determining, using a position sensor of the load-bearing mechanism, the relative distance while the actuator adjusts the relative distance; and after the actuator adjusts the relative distance, supporting the user using the user support while the user applies a first load to the loading interface to perform an exercise. In one or more embodiments, the method further includes: determining, using a force sensor of the load-bearing mechanism, the first load applied to the loading interface by the user. In one or more embodiments, the exercise performed by the user is an isometric exercise. In one or more embodiments, adjusting, using the actuator of the load-bearing mechanism, the relative distance includes: extending or retracting the relative distance in response to the user: entering an input into a user interface of a control unit, which control unit communicates control signals to the actuator of the load-bearing mechanism; or applying a second load to the loading interface. In one or more embodiments, adjusting, using the actuator of the load-bearing mechanism, the relative distance includes: extending or retracting the relative distance in response to the user entering the input into the user interface of the control unit; and the input includes identifying information associating the user with a target setting retrievable via the control unit, which target setting is based on a previous use of the exercise apparatus, or a similar exercise apparatus, by the user. In one or more embodiments, adjusting, using the actuator of the load-bearing mechanism, the relative distance includes: extending or retracting the relative distance in response to the user entering the input into the user interface of the control unit; and the input includes a target setting. In one or more embodiments, adjusting, using the actuator of the load-bearing mechanism, the relative distance includes: extending or retracting the relative distance in response to: the user applying the second load to the loading interface; and determining, using a force sensor of the load-bearing mechanism, that the second load applied to the loading interface by the user has exceeded a threshold. In one or more embodiments, the method further includes: determining, using a force sensor of the load-bearing mechanism, that a halt-force threshold has been exceeded during the extension or retraction of the relative distance; and in response to determining that the halt force has been exceeded, locking the actuator. In one or more embodiments, the method further includes: determining, using the position sensor of the load-bearing mechanism, that the relative distance has been over-extended or over-retracted; and in response to determining that that the relative distance has been over-extended or over-retracted, locking the actuator.

A system has also been disclosed. The system generally includes: a non-transitory computer readable medium; and a plurality of instructions stored on the non-transitory computer readable medium and executable by one or more processors to implement the following steps: adjusting, using an actuator of a load-bearing mechanism, a relative distance between a user support and a loading interface of an exercise apparatus to thereby accommodate a user; determining, using a position sensor of the load-bearing mechanism, the relative distance while the actuator adjusts the relative distance; and after the actuator adjusts the relative distance, supporting the user using the user support while the user applies a first load to the loading interface to perform an exercise. In one or more embodiments, the instructions are executable by the one or more processors to implement the following additional step: determining, using a force sensor of the load-bearing mechanism, the first load applied to the loading interface by the user. In one or more embodiments, the exercise performed by the user is an isometric exercise. In one or more embodiments, adjusting, using the actuator of the load-bearing mechanism, the relative distance includes: extending or retracting the relative distance in response to the user: entering an input into a user interface of a control unit, which control unit communicates control signals to the actuator of the load-bearing mechanism; or applying a second load to the loading interface. In one or more embodiments, adjusting, using the actuator of the load-bearing mechanism, the relative distance includes: extending or retracting the relative distance in response to the user entering the input into the user interface of the control unit; and the input includes identifying information associating the user with a target setting retrievable via the control unit, which target setting is based on a previous use of the exercise apparatus, or a similar exercise apparatus, by the user. In one or more embodiments, adjusting, using the actuator of the load-bearing mechanism, the relative distance includes: extending or retracting the relative distance in response to the user entering the input into the user interface of the control unit; and the input includes a target setting. In one or more embodiments, adjusting, using the actuator of the load-bearing mechanism, the relative distance includes: extending or retracting the relative distance in response to: the user applying the second load to the loading interface; and determining, using a force sensor of the load-bearing mechanism, that the second load applied to the loading interface by the user has exceeded a threshold. In one or more embodiments, the instructions are executable by the one or more processors to implement the following additional step: determining, using a force sensor of the load-bearing mechanism, that a halt-force threshold has been exceeded during the extension or retraction of the relative distance; and in response to determining that the halt force has been exceeded, locking the actuator. In one or more embodiments, the instructions are executable by the one or more processors to implement the following additional step: determining, using the position sensor of the load-bearing mechanism, that the relative distance has been over-extended or over-retracted; and in response to determining that that the relative distance has been over-extended or over-retracted, locking the actuator.

An exercise apparatus has been disclosed according to one or more embodiments of the present disclosure. In one or more embodiments, the exercise apparatus comprises: a loading interface; a user support; and a load-bearing mechanism operably coupled between the loading interface and the user support. In one or more embodiments, the load-bearing mechanism comprises: an actuator; a position sensor; and a force sensor.

A load-bearing mechanism has been disclosed according to one or more embodiments of the present disclosure. In one or more embodiments, the load-bearing mechanism comprises: an actuator; a position sensor; and a force sensor.

A method has been disclosed according to one or more embodiments of the present disclosure. In one or more embodiments, the method includes adjusting a relative distance between a loading interface and a user support of an exercise apparatus using a load-bearing mechanism to accommodate users of varying size.

An apparatus has been disclosed according to one or more embodiments of the present disclosure.

A system has been disclosed according to one or more embodiments of the present disclosure.

A kit has been disclosed according to one or more embodiments of the present disclosure.

A method has been disclosed according to one or more embodiments of the present disclosure.

An apparatus has been disclosed according to one or more embodiments of the present disclosure, the apparatus comprising a non-transitory computer readable medium and a plurality of instructions stored thereon and executable by one or more processors.

It is understood that variations may be made in the foregoing without departing from the scope of the present disclosure.

In one or more embodiments, the elements and teachings of the various embodiments may be combined in whole or in part in some (or all) of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only, may be relative to other features or references, and do not necessarily limit the specific orientation or location of the structure described above.

In one or more embodiments, while different steps, processes, and procedures are described as appearing as distinct acts, one or more of the steps, one or more of the processes, and/or one or more of the procedures may also be performed in different orders, simultaneously and/or sequentially. In one or more embodiments, the steps, processes, and/or procedures may be merged into one or more steps, processes and/or procedures.

In several embodiments, one or more of the operational steps in each embodiment may be omitted. Moreover, in some instances, some features of the present disclosure may be employed without a corresponding use of the other features. Moreover, one or more of the embodiments disclosed above, and/or variations thereof, may be combined in whole or in part with any one or more of the other embodiments described above, and/or variations thereof.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112 (f) for any limitations of any of the claims herein, except for those in which the claim expressly uses the word "means" together with an associated function.

What is claimed is:

1. A method, comprising:

adjusting, using an actuator of a load-bearing mechanism, a relative distance between a user support and a loading interface of an exercise apparatus to thereby accommodate a user;

determining, using a position sensor of the load-bearing mechanism, the relative distance while the actuator adjusts the relative distance; and after the actuator adjusts the relative distance, supporting the user using the user support while the user applies a first load to the loading interface to perform an exercise;

wherein adjusting, using the actuator of the load-bearing mechanism, the relative distance comprises:

extending or retracting the relative distance in response to the user:

entering an input into a user interface of a control unit, which control unit communicates control signals to the actuator of the load-bearing mechanism; or applying a second load to the loading interface;

and wherein adjusting, using the actuator of the load-bearing mechanism, the relative distance comprises:

extending or retracting the relative distance in response to:

the user applying the second load to the loading interface; and determining, using a force sensor of the load-bearing mechanism, that the second load applied to the loading interface by the user has exceeded a threshold.

2. The method of claim 1, further comprising:

determining, using a force sensor of the load-bearing mechanism, the first load applied to the loading interface by the user.

3. The method of claim 2, wherein the exercise performed by the user is an isometric exercise.

4. A method, comprising:

adjusting, using an actuator of a load-bearing mechanism, a relative distance between a user support and a loading interface of an exercise apparatus to thereby accommodate a user;

determining, using a position sensor of the load-bearing mechanism, the relative distance while the actuator adjusts the relative distance; and after the actuator adjusts the relative distance, supporting the user using the user support while the user applies a first load to the loading interface to perform an exercise;

wherein adjusting, using the actuator of the load-bearing mechanism, the relative distance comprises:

extending or retracting the relative distance in response to the user:

entering an input into a user interface of a control unit, which control unit communicates control signals to the actuator of the load-bearing mechanism; or applying a second load to the loading interface;

and wherein the method further comprises:

determining, using a force sensor of the load-bearing mechanism, that a halt-force threshold has been exceeded during the extension or retraction of the relative distance; and in response to determining that the halt force has been exceeded, locking the actuator.

5. The method of claim 4, further comprising:

determining, using the force sensor of the load-bearing mechanism, the first load applied to the loading interface by the user.

6. The method of claim 5, wherein the exercise performed by the user is an isometric exercise.

7. The method of claim 4, wherein adjusting, using the actuator of the load-bearing mechanism, the relative distance comprises:

extending or retracting the relative distance in response to the user entering the input into the user interface of the control unit;

and wherein the input comprises identifying information associating the user with a target setting retrievable via the control unit, which target setting is based on a previous use of the exercise apparatus, or a similar exercise apparatus, by the user.

8. The method of claim 4, wherein adjusting, using the actuator of the load-bearing mechanism, the relative distance comprises:

extending or retracting the relative distance in response to the user entering the input into the user interface of the control unit;

and wherein the input comprises a target setting.

9. A method, comprising:

adjusting, using an actuator of a load-bearing mechanism, a relative distance between a user support and a loading interface of an exercise apparatus to thereby accommodate a user;

determining, using a position sensor of the load-bearing mechanism, the relative distance while the actuator adjusts the relative distance; and after the actuator adjusts the relative distance, supporting the user using the user support while the user applies a first load to the loading interface to perform an exercise;

wherein adjusting, using the actuator of the load-bearing mechanism, the relative distance comprises:

extending or retracting the relative distance in response to the user:

entering an input into a user interface of a control unit, which control unit communicates control signals to the actuator of the load-bearing mechanism; or applying a second load to the loading interface;

and wherein the method further comprises:

determining, using the position sensor of the load-bearing mechanism, that the relative distance has been over-extended or over-retracted; and in response to determining that that the relative distance has been over-extended or over-retracted, locking the actuator.

10. The method of claim 9, further comprising:

determining, using the force sensor of the load-bearing mechanism, the first load applied to the loading interface by the user.

11. The method of claim 10, wherein the exercise performed by the user is an isometric exercise.

12. The method of claim 9, wherein adjusting, using the actuator of the load-bearing mechanism, the relative distance comprises:

extending or retracting the relative distance in response to the user entering the input into the user interface of the control unit;

and wherein the input comprises identifying information associating the user with a target setting retrievable via the control unit, which target setting is based on a previous use of the exercise apparatus, or a similar exercise apparatus, by the user.

13. The method of claim 9, wherein adjusting, using the actuator of the load-bearing mechanism, the relative distance comprises:

extending or retracting the relative distance in response to the user entering the input into the user interface of the control unit;

and wherein the input comprises a target setting.

14. A system, comprising:

a non-transitory computer readable medium; and a plurality of instructions stored on the non-transitory computer readable medium and executable by one or more processors to implement the following steps:

adjusting, using an actuator of a load-bearing mechanism, a relative distance between a user support and a loading interface of an exercise apparatus to thereby accommodate a user;

determining, using a position sensor of the load-bearing mechanism, the relative distance while the actuator adjusts the relative distance; and after the actuator adjusts the relative distance, supporting the user using the user support while the user applies a first load to the loading interface to perform an exercise;

wherein adjusting, using the actuator of the load-bearing mechanism, the relative distance comprises:

extending or retracting the relative distance in response to the user:

entering an input into a user interface of a control unit, which control unit communicates control signals to the actuator of the load-bearing mechanism; or applying a second load to the loading interface;

and wherein adjusting, using the actuator of the load-bearing mechanism, the relative distance comprises:

extending or retracting the relative distance in response to:

the user applying the second load to the loading interface; and determining, using a force sensor of the load-bearing mechanism, that the second load applied to the loading interface by the user has exceeded a threshold.

15. The system of claim 14, wherein the instructions are executable by the one or more processors to implement the following additional step:

determining, using the force sensor of the load-bearing mechanism, the first load applied to the loading interface by the user.

16. The system of claim 15, wherein the exercise performed by the user is an isometric exercise.

17. A system, comprising:

a non-transitory computer readable medium; and a plurality of instructions stored on the non-transitory computer readable medium and executable by one or more processors to implement the following steps:

adjusting, using an actuator of a load-bearing mechanism, a relative distance between a user support and a loading interface of an exercise apparatus to thereby accommodate a user;

determining, using a position sensor of the load-bearing mechanism, the relative distance while the actuator adjusts the relative distance; and after the actuator adjusts the relative distance, supporting the user using the user support while the user applies a first load to the loading interface to perform an exercise;

wherein adjusting, using the actuator of the load-bearing mechanism, the relative distance comprises:

extending or retracting the relative distance in response to the user:

entering an input into a user interface of a control unit, which control unit communicates control signals to the actuator of the load-bearing mechanism; or applying a second load to the loading interface;

and wherein the instructions are executable by the one or more processors to implement the following additional step:

determining, using a force sensor of the load-bearing mechanism, that a halt-force threshold has been exceeded during the extension or retraction of the relative distance; and in response to determining that the halt force has been exceeded, locking the actuator.

18. The system of claim 17, wherein the instructions are executable by the one or more processors to implement the following additional step:

determining, using the force sensor of the load-bearing mechanism, the first load applied to the loading interface by the user.

19. The system of claim 18, wherein the exercise performed by the user is an isometric exercise.

20. The system of claim 17, wherein adjusting, using the actuator of the load-bearing mechanism, the relative distance comprises:

extending or retracting the relative distance in response to the user entering the input into the user interface of the control unit;

and wherein the input comprises identifying information associating the user with a target setting retrievable via the control unit, which target setting is based on a previous use of the exercise apparatus, or a similar exercise apparatus, by the user.

21. The system of claim 17, wherein adjusting, using the actuator of the load-bearing mechanism, the relative distance comprises:

extending or retracting the relative distance in response to the user entering the input into the user interface of the control unit;

and wherein the input comprises a target setting.

22. A system, comprising:

a non-transitory computer readable medium; and a plurality of instructions stored on the non-transitory computer readable medium and executable by one or more processors to implement the following steps:

adjusting, using an actuator of a load-bearing mechanism, a relative distance between a user support and a loading interface of an exercise apparatus to thereby accommodate a user;

determining, using a position sensor of the load-bearing mechanism, the relative distance while the actuator adjusts the relative distance; and after the actuator adjusts the relative distance, supporting the user using the user support while the user applies a first load to the loading interface to perform an exercise;

wherein adjusting, using the actuator of the load-bearing mechanism, the relative distance comprises:

extending or retracting the relative distance in response to the user:

entering an input into a user interface of a control unit, which control unit communicates control signals to the actuator of the load-bearing mechanism; or applying a second load to the loading interface;

and wherein the instructions are executable by the one or more processors to implement the following additional step:

determining, using the position sensor of the load-bearing mechanism, that the relative distance has been over-extended or over-retracted; and in response to determining that that the relative distance has been over-extended or over-retracted, locking the actuator.

23. The system of claim 22, wherein the instructions are executable by the one or more processors to implement the following additional step:

determining, using a force sensor of the load-bearing mechanism, the first load applied to the loading interface by the user.

24. The system of claim 23, wherein the exercise performed by the user is an isometric exercise.

25. The system of claim 22, wherein adjusting, using the actuator of the load-bearing mechanism, the relative distance comprises:

extending or retracting the relative distance in response to the user entering the input into the user interface of the control unit;

and wherein the input comprises identifying information associating the user with a target setting retrievable via the control unit, which target setting is based on a previous use of the exercise apparatus, or a similar exercise apparatus, by the user.

26. The system of claim 22, wherein adjusting, using the actuator of the load-bearing mechanism, the relative distance comprises:

extending or retracting the relative distance in response to the user entering the input into the user interface of the control unit;

and wherein the input comprises a target setting.

* * * * *